US006714746B2

(12) United States Patent
Morioka et al.

(10) Patent No.: US 6,714,746 B2
(45) Date of Patent: Mar. 30, 2004

(54) IMAGE FORMING APPARATUS ROTATIONALLY DRIVING IMAGE BEARING MEMBER AND CONTACT ELECTRIFYING MEMBER OF PROCESS CARTRIDGE AND PROCESS CARTRIDGE COMPRISING IMAGE BEARING MEMBER AND CONTACT ELECTRIFYING MEMBER

(75) Inventors: Masanari Morioka, Shizuoka (JP); Yoshikazu Sasago, Shizuoka (JP); Yoshiyuki Batori, Shizuoka (JP); Takashi Akutsu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/050,929

(22) Filed: Jan. 22, 2002

(65) Prior Publication Data

US 2002/0159779 A1 Oct. 31, 2002

(30) Foreign Application Priority Data

Jan. 23, 2001 (JP) ..... 2001-014504
Jan. 26, 2001 (JP) ..... 2001-018855

(51) Int. Cl.[7] ..... G03G 15/08; G03G 15/02; G03G 15/00

(52) U.S. Cl. ..... 399/27; 399/50; 399/167

(58) Field of Search ..... 399/27, 29, 30, 399/25, 50, 167, 174, 175, 176

(56) References Cited

U.S. PATENT DOCUMENTS 5,331,372 A 7/1994 Tsuda et al.
5,404,198 A 4/1995 Noda et al.
5,426,489 A * 6/1995 Haneda et al. ..... 399/175 X
5,470,635 A 11/1995 Shirai et al. ..... 428/131
5,475,470 A 12/1995 Sasago et al.
5,488,459 A 1/1996 Tsuda et al.
5,499,081 A * 3/1996 Mizude et al. ..... 399/167 X
5,510,878 A 4/1996 Noda et al.
5,532,795 A * 7/1996 Tatsumi et al. ..... 399/167 X
5,583,613 A 12/1996 Kobayashi et al.
5,602,623 A 2/1997 Nishibata et al. ..... 399/111
5,608,509 A 3/1997 Shirai et al. ..... 399/351
5,623,328 A 4/1997 Tsuda et al. ..... 399/111
5,659,847 A 8/1997 Tsuda et al. ..... 399/113
5,669,042 A 9/1997 Kobayashi et al. ..... 399/111

(List continued on next page.)

FOREIGN PATENT DOCUMENTS

JP 6-3921 1/1994
JP 10-307454 11/1998
JP 10-307455 11/1998
JP 10-307456 11/1998
JP 10-307457 11/1998
JP 10-307458 11/1998
JP 10-307459 11/1998
JP 11-282239 10/1999

*Primary Examiner*—Sandra Brase
(74) *Attorney, Agent, or Firm*—Fitzpatrick, Cella, Harper & Scinto

(57) ABSTRACT

A cartridge is provided in which an electrifying roller is driven in a counter direction to photosensitive member drum and which has a toner remaining amount detector and a memory, and the electrifying roller is driven by an electrifying roller drive motor. The electrifying roller optimum rotation speed stored in the memory in advance is accessed when the toner remaining amount reaches a predetermined value, and the electrifying roller rotation speed is changed in accordance with the electrifying roller optimum rotation speed. The accumulated distance by which the photosensitive member drum and the electrifying roller abrasively slide is written in the memory, and when the toner remaining amount reaches a predetermined value, the electrifying roller optimum rotation speed corresponding to the abrasive sliding distance is accessed. The electrifying roller rotation speed is changed in accordance with the electrifying roller optimum rotation speed.

42 Claims, 20 Drawing Sheets

U.S. PATENT DOCUMENTS

| | | | | | |
|---|---|---|---|---|---|
| 5,749,027 | A | | 5/1998 | Ikemoto et al. | 399/113 |
| 5,768,653 | A | * | 6/1998 | Fare | 399/50 |
| 5,774,766 | A | | 6/1998 | Karakama et al. | 399/111 |
| 5,794,101 | A | | 8/1998 | Watanabe et al. | 399/103 |
| 5,809,379 | A | | 9/1998 | Yano et al. | 399/159 |
| 5,828,928 | A | | 10/1998 | Sasago et al. | 399/111 |
| 5,878,310 | A | | 3/1999 | Noda et al. | 399/117 |
| 5,890,036 | A | | 3/1999 | Karakama et al. | 399/119 |
| 5,899,602 | A | | 5/1999 | Noda et al. | 399/111 |
| 5,911,096 | A | | 6/1999 | Batori et al. | 399/111 |
| 5,920,752 | A | | 7/1999 | Karakama et al. | 399/111 |
| 5,920,753 | A | | 7/1999 | Sasaki et al. | 399/111 |
| 5,923,917 | A | * | 7/1999 | Sakurai et al. | 399/27 |
| 5,930,562 | A | | 7/1999 | Noda et al. | 399/114 |
| 5,937,237 | A | | 8/1999 | Nonaka et al. | 399/106 |
| 5,940,658 | A | | 8/1999 | Yokoi et al. | 399/119 |
| 5,943,528 | A | | 8/1999 | Akutsu et al. | 399/110 |
| 6,009,288 | A | | 12/1999 | Akutsu | 399/111 |
| 6,072,968 | A | | 6/2000 | Nomura et al. | 399/113 |
| 6,075,957 | A | | 6/2000 | Batori et al. | 399/114 |
| 6,078,764 | A | | 6/2000 | Akutsu | 399/114 |
| 6,081,681 | A | | 6/2000 | Nagase et al. | 399/174 |
| 6,101,348 | A | | 8/2000 | Nonaka et al. | 399/103 |
| 6,104,894 | A | | 8/2000 | Sato et al. | 399/106 |
| 6,115,569 | A | | 9/2000 | Akutsu | 399/111 |
| 6,128,456 | A | | 10/2000 | Chigono et al. | 399/176 |
| 6,131,007 | A | | 10/2000 | Yamaguchi et al. | 399/256 |
| 6,134,407 | A | | 10/2000 | Ishiyama et al. | 399/174 |
| 6,137,970 | A | | 10/2000 | Sasago | 399/106 |
| 6,275,668 | B1 | | 8/2001 | Batori | 399/90 |
| 6,334,035 | B1 | | 12/2001 | Abe et al. | 399/106 |
| 6,363,226 | B1 | | 3/2002 | Batori | 399/8 |

* cited by examiner

IMAGE FORMING APPARATUS ROTATIONALLY DRIVING IMAGE BEARING MEMBER AND CONTACT ELECTRIFYING MEMBER OF PROCESS CARTRIDGE AND PROCESS CARTRIDGE COMPRISING IMAGE BEARING MEMBER AND CONTACT ELECTRIFYING MEMBER

BACKGROUND OF THE INVENTION

1. Field of the Invention

The present invention relates to an image forming apparatus such as an electrophotographic image forming apparatus to which a contact electrifying means is applied, and a process cartridge which is detachably attachable onto the image forming apparatus.

In this specification, the electrophotographic image forming apparatus is so adapted as to form an image on a recording medium by using an electrophotographic image forming system. The electrophotographic image forming apparatus is exemplified by an electrophotographic copying machine, an electrophotographic printer (for example, a laser beam printer and an LED printer), a facsimile machine, a word processor and so on.

Also, the process cartridge is so adapted as to integrate an electrifying means with a developing means and an electrophotographic photosensitive member drum into a cartridge, and to make the cartridge detachably attachable to an electrophotographic image forming apparatus main body. Also, the process cartridge is so adapted as to integrate the electrifying means with the electrophotographic photosensitive member drum into a cartridge so as to be detachably attachable on the electrophotographic image forming apparatus main body.

2. Related Background Art

Up to now, in an image forming apparatus using an electrophotographic image forming process, there is applied a process cartridge system in which the electrophotographic photosensitive member and the process means that affects the electrophotographic photosensitive member are integrated into a cartridge, and the cartridge is detachably attached to the image forming apparatus.

The process cartridge system can remarkably improve the operability since the maintenance of the device can be conducted by a user per se without relying on a service man. For that reason, the process cartridge system has been widely employed in the image forming apparatus.

In the above-mentioned image forming apparatus and process cartridge, an electrifying process for electrifying an image bearing member to a uniform potential is required in formation of an electrostatic latent image on the image bearing member, and a corona electrifying apparatus (non-contact with the image bearing member) has been frequently employed as the electrifying apparatus. However, the corona electrifying apparatus has suffered from such problems in that a large amount of ozone is generated, and that a high voltage of about 10 kV must be applied between the electrifying apparatus and the image bearing member, and so on.

As the electrifying means that solves the above problems, in recent years, a so-called contact electrifying apparatus, in which a voltage is applied to an electrifying member that is in direct contact with the image bearing member to uniformly electrify the image bearing member, has been proposed and put in practical use.

A representative one of the above-mentioned contact electrifying apparatus is a roller electrifying apparatus in which a middle-resistant layer is disposed on a front layer of a conductive base roller, and the roller is rotated in accordance with the rotation of the image bearing member. A predetermined voltage is applied between the roller and the image bearing member by a power supply, to thereby electrify the image bearing member to a uniform potential.

There are two voltage applying methods stated below:

1) a method of applying only a d.c. voltage; and
2) a method of applying a voltage resulting from superimposing an a.c. voltage on a d.c. voltage.

In case of the above method 1), for example, in order to set the potential of the image bearing member to −600 V, it is necessary to apply a voltage of about −1300 V to the electrifying member. In case of the above method 2), the potential of the image bearing member can be similarly set to −600 V by applying a d.c. voltage of −600 V and a superimposed a.c. voltage of 1500 Vpp or higher.

In this case, the electrifying mechanism complies with the Paschen's law in any case, in which a discharge phenomenon occurs in a region that satisfies Paschen's law to electrify the image bearing member when the roller and the image bearing member are located at a specific distance.

However, the contact electrifying apparatus of this type conducts the same operation as that of the corona discharging device that has been initially described, and generates ozone, although the amount of ozone is remarkably suppressed as compared with the corona electrifying apparatus, as is apparent from the above-mentioned electrifying mechanism. Ozone generates nitrogen oxide and leads to a phenomenon that, in the case where nitrogen oxide sticks onto the image bearing member, an image defect occurs due to electrifying failure because the resistance of nitrogen oxide is low.

Under the circumstances, Japanese Patent Application Laid-open No. 6-3921 has proposed an electrifying process that eliminates the above-mentioned problem of ozone occurrence and can further lower a voltage applied to the electrifying apparatus with the elimination of the above-mentioned problem.

In this electrifying process the surface potential of the image bearing member can be set to substantially the same potential as the voltage applied to the electrifying apparatus. This is enabled by performing charge injection to the image bearing member by directly transferring the charges with respect to the image bearing member surface that is in contact with the electrifying member without using the discharge phenomenon.

As the electrifying apparatus for realizing the above-mentioned injection electrifying process, a sponge roller electrifying apparatus will be described. In this type, relatively low resistant particles (conductive particles), which are called charge accelerating particles, are stuck on a blank shell portion in the surface of the electrifying sponge roller that is in contact with the image bearing member. The contact electrifying system (direct injection electrifying) using the charge accelerating particles has been disclosed in Japanese Patent Application Laid-open No. 10-307454, Japanese Patent Application Laid-open No. 10-307455, Japanese Patent Application Laid-open No. 10-307456, Japanese Patent Application Laid-open No. 10-307457, Japanese Patent Application Laid-open No. 10-307458, Japanese Patent Application Laid-open No. 10-307459, and so on. In this system, a d.c. voltage of −600 V is applied to the electrifying sponge roller by a power supply. For that reason, a portion of the image bearing member which is in contact with the electrifying sponge roller is going to have the same potential as the d.c. voltage. In this situation, if charges are injected from the electrifying sponge roller to the image bearing member over the energy barrier of the image bearing member surface, the image bearing member is electrified. On the other hand, in the case where the charges are again moved to the electrifying sponge roller from the image bearing member when the charges cannot go over the energy barrier or the electrifying sponge roller and the image bearing member are spaced apart from each other, the image bearing member is not electrified. This phenomenon largely depends on the energy barrier or the charge retaining capacity of the surface of the image bearing member, whereas if the phenomenon is considered as a competing reaction, the frequency of opportunities that the electrifying sponge roller comes in contact with the image bearing member becomes important.

In order to increase the frequency, it is effective to stick the charge accelerating particles onto the surface of the electrifying sponge roller to enhance the adhesion of the electrifying sponge roller with the image bearing member, and to reverse the rotating direction of the electrifying sponge roller with respect to the forward direction of the image bearing member (the contact surfaces of the image bearing member and the electrifying sponge roller move in opposite directions while being abrasively slid on each other) to increase the relative speed, to thereby increase the number of times the image bearing member contacts the electrifying sponge roller per unit time.

With the above-mentioned structure, the surface potential of the image bearing member is set to substantially the same potential of −600 V which is applied to the electrifying sponge roller, and uniform electrifying is enabled in a micro portion without any electrifying unevenness.

The charge accelerating particles remain on the image bearing member without being transferred onto a transfer paper by a transferring apparatus by making the electrifying polarity of the charge accelerating particles opposite to that of a developer, and the charge accelerating particles are collected on the electrifying sponge roller, to thereby always obtain a new injection site.

In this type, after an image on the image bearing member has been transferred, a non-transferred developer can have appropriate charges by conducting charge injection as in the image bearing member while the non-transferred developer passes between the charge accelerating particles that is being subjected to the electrifying process and the image bearing member. Therefore, the non-transferred developer is collected in a developing apparatus without passing through a region where the developing process is conducted as it is. Therefore, it is possible to realize an electrophotographic process having no cleaner.

However, there is a case in which there occurs the deterioration of electrifying performance due to a long-period use, and in more detail, the deterioration of the electrifying uniformity in the above-mentioned injection electrifying system. This is caused by a reduction of a contact area of the charge accelerating particles and the image bearing member mainly due to the developer as an insulator stored on the electrifying sponge roller bits by bits.

SUMMARY OF THE INVENTION

The present invention has been made in view of the above-mentioned circumstances, and therefore an object of the present invention is to provide an image forming apparatus and a process cartridge both using a contact electrifying means, which properly maintain the electrifying performance over a long-period use.

An image forming apparatus according to the present invention to which a process cartridge having an image bearing member, a contact electrifying member for the image bearing member, detection means for detecting a developer remaining amount and storage means is detachably attachable, is characterized by comprising: first drive means for rotationally driving the image bearing member; second drive means for rotationally driving the contact electrifying member; and control means for controlling driving speeds of the first drive means and the second drive means, in which the control means controls the driving speed of the second drive means on the basis of a rotation speed of the second drive means stored in the storage means.

Another image forming apparatus according to the present invention to which a process cartridge having an image bearing member, a contact electrifying member for the image bearing member, detection means for detecting a developer remaining amount and storage means is detachably attachable, is characterized by comprising: first drive means for rotationally driving the image bearing member; second drive means for rotationally driving the contact electrifying member; and control means for controlling driving speeds of the first drive means and the second drive means and calculating the accumulated abrasive sliding distance of the image bearing member and the contact electrifying member: in which the storage means stores one or more rotation speeds of the second drive means corresponding to the accumulated abrasive sliding distance; and the control means controls the driving speed of the second drive means on a basis of the rotation speed stored in the storage means.

Another image forming apparatus according to the present invention to which a process cartridge having an image bearing member, a contact electrifying member for the image bearing member, detection means for detecting a developer remaining amount and storage means is detachably attachable, is characterized by comprising: first drive means for rotationally driving the image bearing member; second drive means for rotationally driving the contact electrifying member; and control means for controlling driving speeds of the first drive means and the second drive means, calculating the accumulated abrasive sliding distance of the image bearing member and the contact electrifying member, and writing two or more of the calculated values and the developer remaining amount or developer consumption amount detected by the detecting means in the storage means, respectively, in which the control means calculates a rotation speed of the second drive means on the basis of two or more of the accumulated abrasive sliding distances and the developer remaining amount or developer consumption amount stored in the storage means to control the second drive means on the basis of the calculated value.

Another image forming apparatus according to the present invention to which a process cartridge having an image bearing member, a contact electrifying member for the image bearing member, detection means for detecting a developer remaining amount and storage means is detachably attachable, is characterized by comprising: first drive means for rotationally driving the image bearing member; second drive means for rotationally driving the contact electrifying member; and control means for rotationally controlling the first drive means at a plurality of drive speeds, and for controlling the driving speed of the second drive means so that the drive speed of the first drive means and the drive speed of the second drive means becomes identical.

Another image forming apparatus according to the present invention is characterized by comprising: an image bearing member, a contact electrifying member for the image bearing member, storage means for storing data according to a developer remaining amount, and control means for variably controlling peripheral speeds of the image bearing member and the contact electrifying means in accordance with the data stored in the storage means. Another image forming apparatus according to the present invention is characterized by comprising: an image bearing member, a contact electrifying member for the image bearing member, storage means for storing data according to a used developer amount, and control means for calculating an accumulated abrasive sliding distance of the image bearing member and the contact electrifying member to variably control peripheral speeds of the image bearing member and the contact electrifying means in accordance with the calculated value and the data stored in the storage means.

A process cartridge according to the present invention which is detachably attachable to an image forming apparatus including first drive means for rotationally driving an image bearing member, second drive means for rotationally driving a contact electrifying member, and control means for controlling driving speeds of the first drive means and the second drive means, is characterized by comprising: the image bearing member, the contact electrifying member for the image bearing member, detection means for detecting a developer remaining amount, and storage means for storing a rotation speed for changing the drive speed of the second drive means.

Another process cartridge according to the present invention which is detachably attachable to an image forming apparatus including first drive means for rotationally driving an image bearing member, second drive means for rotationally driving a contact electrifying member, and control means for controlling driving speeds of the first drive means and the second drive means and calculating the accumulated abrasive sliding distance of the image bearing member and the contact electrifying member, is characterized by comprising: an image bearing member; a contact electrifying member for the image bearing member; detection means for detecting a developer remaining amount; and storage means for storing at least one rotation speed corresponding to the accumulated abrasive sliding distance for controlling the driving speed of the second drive means.

Another process cartridge according to the present invention which is detachably attachable to an image forming apparatus including first drive means for rotationally driving an image bearing member, second drive means for rotationally driving an contact electrifying member, and control means for controlling the driving speeds of the first drive means and the second drive means and calculating the accumulated abrasive sliding distance of the image bearing member and the contact electrifying member, is characterized by comprising: an image bearing member; a contact electrifying member for the image bearing member; detection means for detecting a developer remaining amount; and storage means for storing two or more of the accumulated abrasive sliding distance, and the developer remaining amount or developer consumption amount therein.

According to the present invention, the rotation speed of the contact electrifying member is raised up to a speed written in the storage means in accordance with the developer consumption amount detected by the detection means for detecting the amount of developer, to thereby increase the opportunities of contact of the contact electrifying member with the image bearing member, whereby the electrifying property can be maintained over a long period of time.

Also, the rotation speed is increased by conducting the optimum control of the contact electrifying member by using the developer consumption amount and the abrasive sliding distance between the image bearing member and the contact electrifying member, thereby being capable of maintaining the electrifying property over a long-period use by effectively utilizing the image bearing member lifetime margin.

Also, the rotation speed control of the contact electrifying member is conducted at multiple stages, thereby conducting accurate control regardless of the printing ratio and the variation of the amount of sheets that are continuously printed and maintaining the process cartridge electrifying property for a long period of time.

Since the abrasive sliding target value is made to gradually approach an abrasive sliding limit value, the rotation speed of the contact electrifying member can be gradually increased, thereby maintaining the process cartridge electrifying property for a long period of time.

Since the lifetime of the image bearing member is managed not by an abrasive sliding period of time but an abrasive sliding distance, even if a plurality of image forming process speeds are provided, the lifetime of the image bearing member can be accurately managed.

Also, since the histories of the developer consumption amount and the abrasive sliding distance are recorded in the storage means of the process cartridge, even if the process cartridge is used in another image forming apparatus main body, the electrifying property can be maintained by the optimum contact electrifying member control for a long period of time.

Also, since the histories of the developer consumption amount and the abrasive sliding distance are recorded in the storage means of the process cartridge, after the use of the process cartridge is ended, the process cartridge is collected and the histories of the developer consumption amount and the abrasive sliding distance, which are recorded in the storage means, are read, and the read data is analyzed, thereby determining the use state by a user in more detail.

Also, even if a specification is changed in the process cartridge, if data that is stored in the storage means is changed, the optimum rotation speed of the contact electrifying member can be maintained without adding a change to the image forming apparatus main body.

Also, since the rotation control algorithm of the contact electrifying member is stored in the process cartridge, an improvement of the algorithm can be readily sequentially provided to the user, thereby providing the capability of customizing the algorithm with respect to a specific user.

In the case where an image bearing member abrasion amount (drum abrasion amount) has a margin under the user state by the user, the contact electrifying member rotation speed is changed in accordance with the margin, thereby providing the capability of widening the latitude of the electrifying uniformity.

DETAILED DESCRIPTION OF THE PREFERRED EMBODIMENTS

Now, a description will be given in more detail of preferred embodiments of the present invention with reference to the accompanying drawings.

(First Embodiment)

Figure 1:
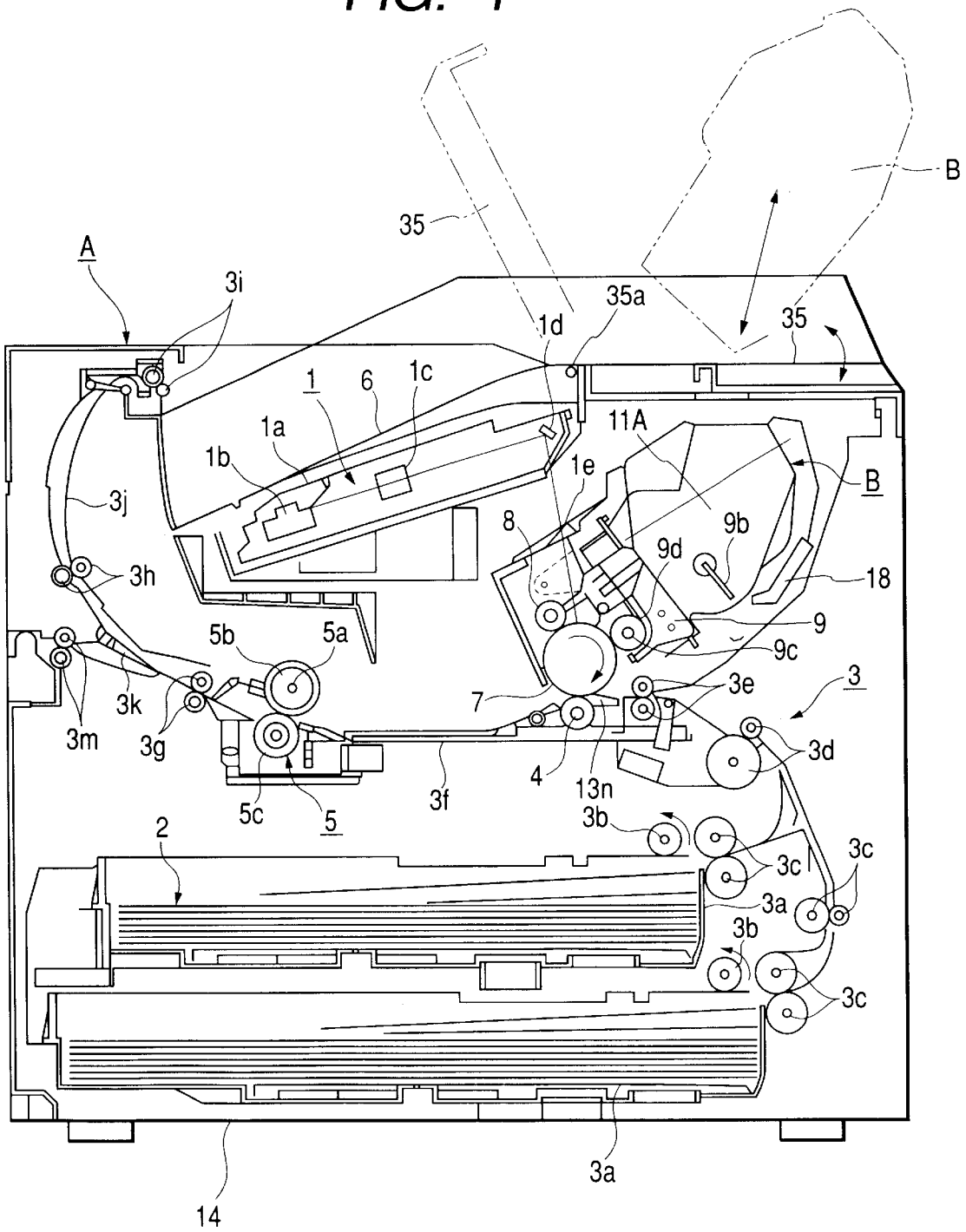
FIG. 1 is a schematic cross-sectional view showing the internal structure of an image forming apparatus in accordance with an embodiment of the present invention.
Figure 2:
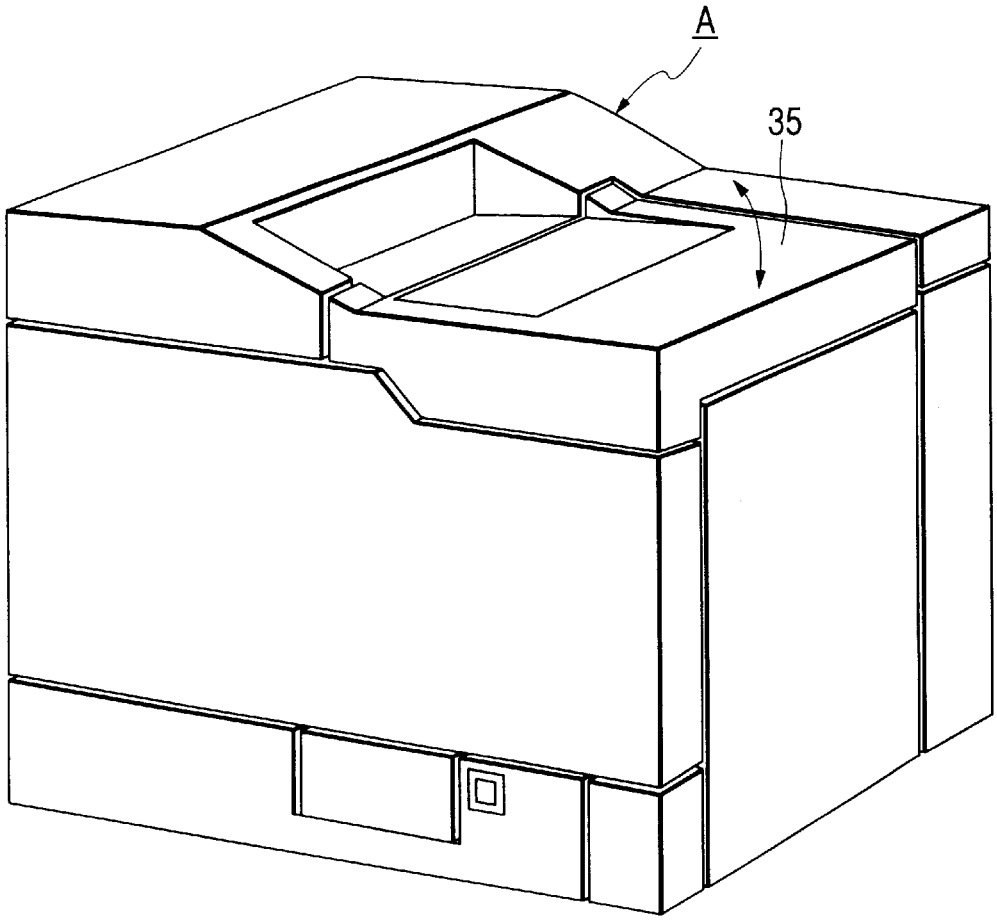
FIG. 2 is a perspective view showing the appearance of the image forming apparatus shown in FIG. 1.

FIG. 1 is a schematic cross-sectional view showing the internal structure of an image forming apparatus in accordance with an embodiment of the present invention, and FIG. 2 is a schematically perspective view showing the appearance of the image forming apparatus shown in FIG. 1.

(1) Image Forming Apparatus A and Process Cartridge B:

An image forming apparatus according to this embodiment is directed to a laser beam printer A that functions as an electrophotographic image forming apparatus and is of a process cartridge detachably attachable system. Reference B denotes a process cartridge.

The laser beam printer A forms a toner image on a drum-shaped electrophotographic photosensitive member 7 (hereinafter referred to as a photosensitive member drum) which functions as an image bearing member through an electrophotographic image forming process, and then transfers the toner image onto a recording medium (for example, a recording paper, an OHP sheet, a cloth or the like) to form an image.

In more detail, the photosensitive member drum 7 is electrified by an electrifying means 8, and a latent image is then formed on the photosensitive member drum 7 in accordance with image information from an optical means 1. The latent image is developed by a developing means 9 to form a toner image.

The recording medium 2 set in a sheet feeding cassette 3*a* is reversed and fed by a pickup roller 3*b*, a pair of conveying rollers 3*c*, 3*d* and a pair of registration rollers 3*e* in synchronism with the formation of the toner image. Then, the toner image formed on the photosensitive member drum 7 is transferred onto the recording medium 2 by applying a voltage to a transferring roller 4 that functions as a transferring means.

Thereafter, the recording medium 2 onto which the toner image has been transferred is conveyed to a fixing means 5 by a conveying guide 3*f*. The fixing means 5 includes a fixing roller 5*b* having a heater 5*a* therein and a driving roller 5*c*. Then, the fixing means 5 applies heat and pressure to the recording medium 2 that is passing through the fixing means 5 to fix the transferred toner image onto the recording medium 2.

The recording medium 2 is conveyed by a pair of discharging rollers 3*g*, 3*h* and 3*i* and discharged to a discharge tray 6 through a reverse path 3*j*. The discharge tray 6 is disposed on a top surface of the apparatus main body 14 of the printer A. A swingable flapper 3*k* may be operated so that the recording medium 2 can be discharged by a pair of discharging rollers 3*m* not through the reverse path 3*j*.

In this embodiment, a conveying means 3 is composed of the pickup roller 3*b*, the pair of conveying rollers 3*c*, 3*d*, the pair of registration rollers 3*e*, the conveying guide 3*f*, the pair of discharging rollers 3*g*, 3*h*, 3*i*, the reverse path 3*j*, the flapper 3*k*, the pair of discharging rollers 3*m* and the like.

The process cartridge B that is detachably attachable to the printer main body includes a photosensitive member drum 7 and at least an electrifying means 8. As another process means contained in the process cartridge B, there are, for example, a developing means 9 that develops the latent image formed on the photosensitive member drum 7, and the like. The process cartridge B according to this embodiment is obtained by integrating the photosensitive member drum 7, the electrifying roller 8 that functions as the electrifying means and the developing means 9 into a cartridge.

The photosensitive member drum 7 that is an electrophotographic photosensitive member having a photosensitive layer 7*e* (FIG. 6) rotates, and a voltage is applied to the electrifying roller 8 that is the electrifying means to uniformly electrify the surface of the photosensitive member drum 7. Then, a laser beam irradiates the photosensitive member drum 7 through an exposure opening 1*e* in accordance with image information from the optical system 1 to form a latent image. The latent image is developed with toner by the developing means 9.

The electrifying roller 8 is so disposed as to be in contact with the photosensitive member drum 7 to electrify the photosensitive member drum 7. A predetermined press force is given to the electrifying roller 8 so that a nip portion is formed on an abutting surface of the electrifying roller 8 against the photosensitive member drum 7, and the electrifying roller 8 rotates by an electrifying roller driving means that will be described below so that the abutting surface moves in an opposite direction with respect to the photosensitive member drum 7. That is, the electrifying roller 8 and the photosensitive member drum 7 rotate in the same direction (clockwise in this embodiment). The support and drive structures of the electrifying roller 8 and the photosensitive member drum 7 will be described later.

The optical system 1 has a laser diode 1*a*, a polygon mirror 1*b*, a lens 1*c* and a reflection mirror 1*d*. The developing means 9 supplies toner to the developing region of the photosensitive member drum 7 to develop the latent image formed on the photosensitive member drum 7. The developing means 9 according to this embodiment is a reversal developing apparatus using magnetic one-component insulating toner (negative toner), which carries the toner within the toner container 11A to a developing roller 9*c* due to the rotation of a toner carrying member 9*b*, rotates the developing roller 9*c* having a fixed magnet therein and forming a toner layer to which frictional electric charges are given by a developing blade 9*d* on the surface of the developing roller 9*c*, to thereby supply the toner to the developing region of the photosensitive member drum 7.

Then, the developing means 9 transfers the toner onto the photosensitive member drum 7 in accordance with the latent image, to thereby form and visualize a toner image.

The developing blade 9*d* regulates the amount of toner on the peripheral surface of the developing roller 9*c* and gives the frictional electric charges.

A toner agitating member 9*e* (FIG. 3) which circulates the toner within the developing chamber is rotatably fitted in the vicinity of the developing roller 9*c*.

The toner is obtained by mixing a binding resin, magnetic particles and an electrification control agent together, subjecting the mixed material to kneading, milling and classifying processes and then adding charge accelerating particle and superplasticizer to the material as an addition agent.

The transfer of the toner image from the photosensitive member drum 7 side to the recording medium 2 side is made by applying a voltage opposite in polarity to the toner image to the transferring roller 4 to transfer the toner image formed on the photosensitive member drum 7 to the recording medium 2.

The printer according to this embodiment is of a cleanerless type, and the non-transferred toner that remains on the photosensitive member drum 7 surface after the toner image has been transferred onto the recording medium 2 reaches the developing means 9 through the electrifying means 8 with rotation of the photosensitive member drum 7 without being removed by a cleaner, and is then collected simultaneously when developing is made (so-called toner recycle process).

Figure 3:
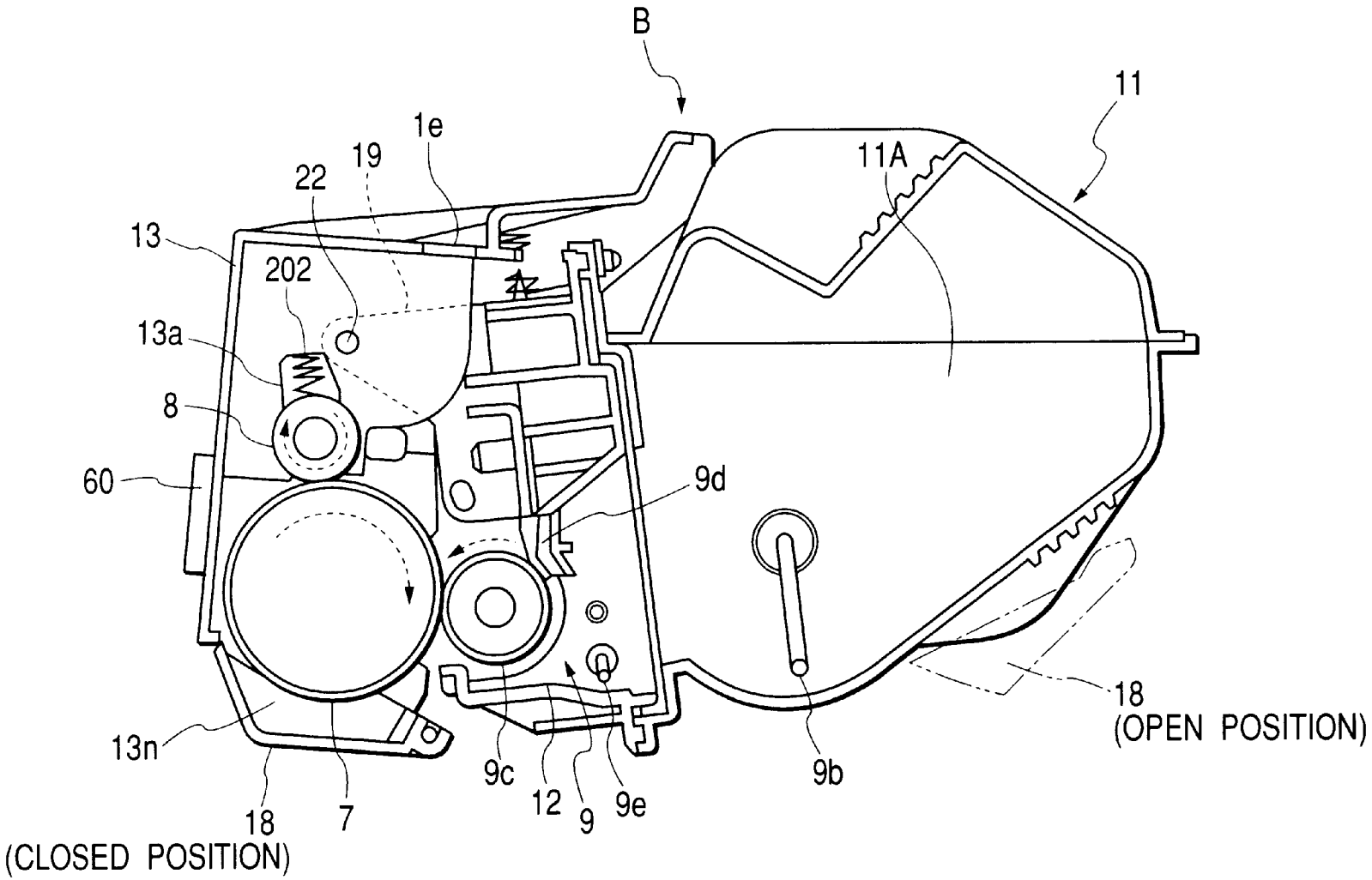
FIG. 3 is a schematic cross-sectional view showing a process cartridge according to the present invention.
Figure 4:
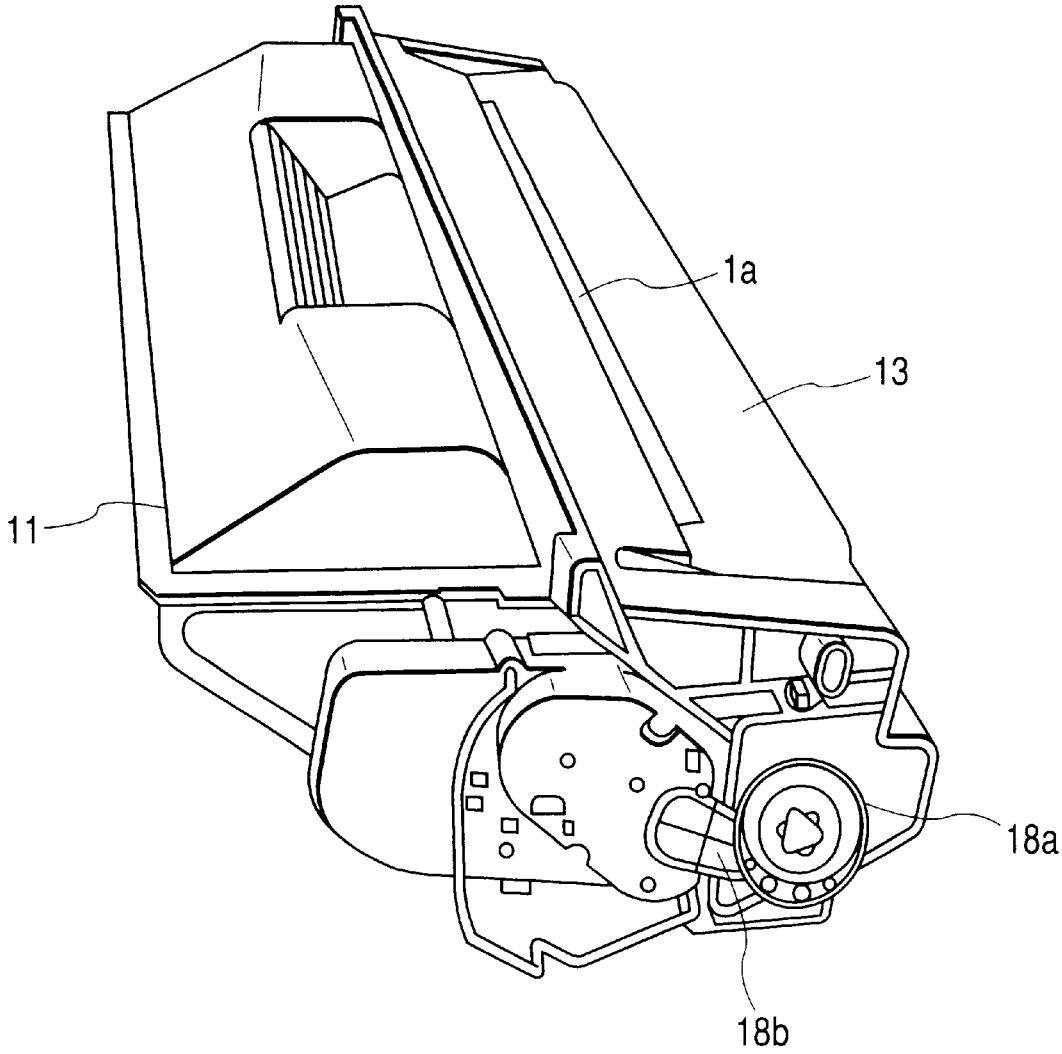
FIG. 4 is a schematic perspective view showing the appearance of the process cartridge according to the present invention.
Figure 5:
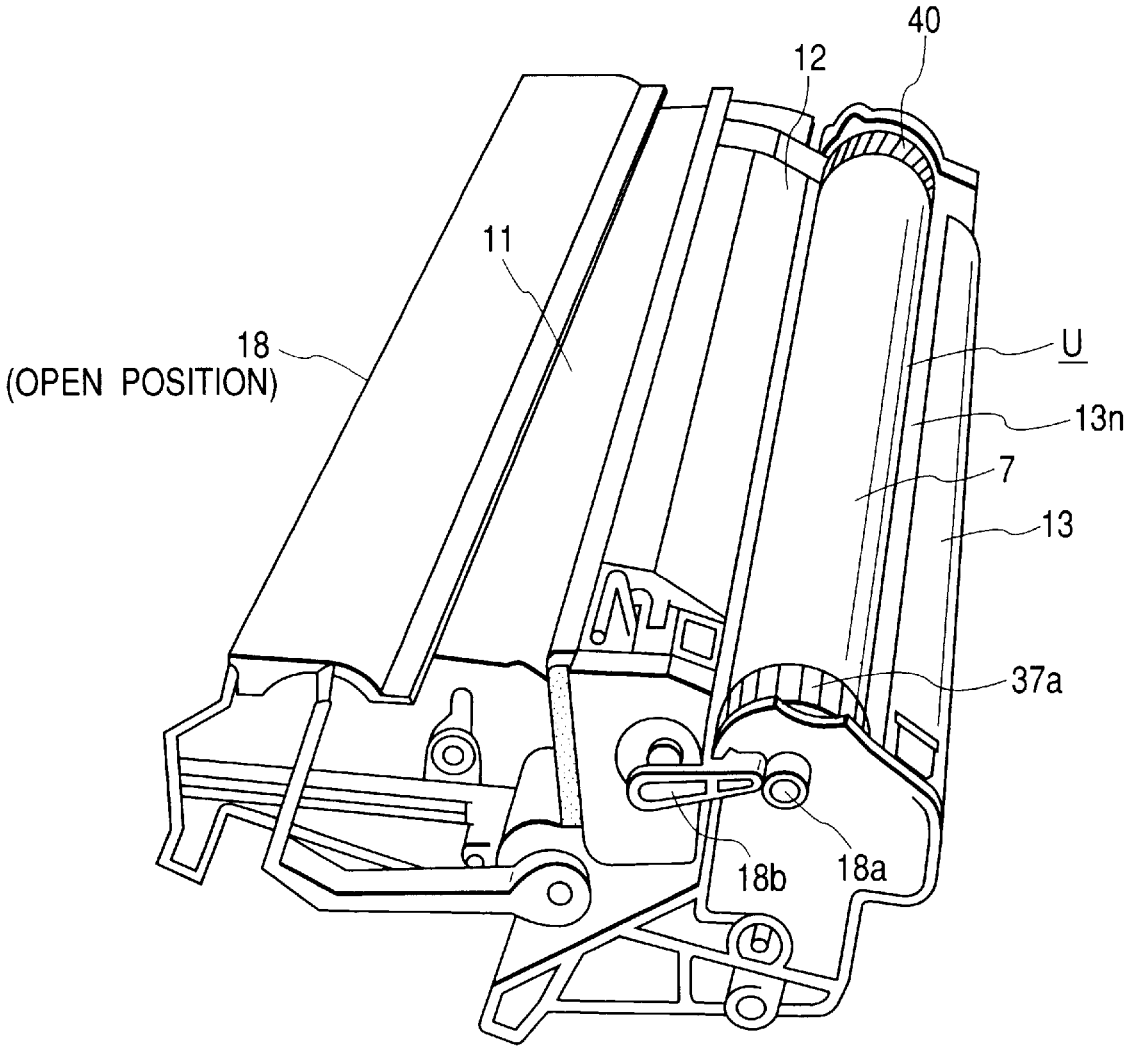
FIG. 5 is a schematic perspective view showing the appearance of the process cartridge according to the present invention (a schematically perspective view showing the appearance in a state where the process cartridge is turned over and a drum shutter member is opened)

FIG. 3 is a schematic lateral cross-sectional view showing the inside structure of a process cartridge B in accordance with the present invention; FIG. 4 is a schematic perspective view showing the appearance of the process cartridge B; and FIG. 5 is a schematic perspective view showing the appearance of the process cartridge in a state where the process cartridge turns over and a drum shutter member is opened.

The process cartridge B is designed such that a toner frame 11 having a toner container (toner receiving portion) 11A which receives the toner therein and a developing frame 12 that holds the developing means 9 such as the developing roller 9*c* are coupled to each other and then rotatably coupled with a drum frame 13 to which the photosensitive member drum 7 and the electrifying roller 8 are fitted through an arm portion 19 and a shaft portion 22 into a cartridge.

Also, the process cartridge B has an exposure opening portion 1*e* for irradiating the photosensitive drum 7 with a light beam corresponding to the image information, and a transfer opening portion 13*n* for allowing the photosensitive member drum 7 to face the recording medium 2 or the transferring roller 4. In more detail, the exposure opening portion 1*e* is provided in the drum frame 13, and the transfer opening portion 13*n* is formed between the developing frame 12 and the drum frame 13.

In addition, in the process cartridge B, a drum shutter member 18 that covers the transfer opening portion 13*n* when being removed from the printer main body 14 and protects the photosensitive member drum 7 from being exposed by a light for a long period of time or being in contact with foreign material is rotatably disposed on the developing frame 12. FIG. 3 shows a state in which the transfer opening portion 13*n* is covered with the drum shutter member 18.

The process cartridge B is detachably attachable to the printer main body 14 by an operator, and the cartridge detachably attaching means is designed such that when the open/close member 35 of the printer main body 14 is opened with the shaft 35*a* as a center as indicated by a chain double-dashed line of FIG. 1, a space for the cartridge mounting portion appears within the printer main body 14, and cartridge mounting guide members (not shown) are disposed on the right and left sides of the space, and guides 18*a* and 18*b* (FIGS. 4 and 5) of the process cartridge B are inserted into the mounting guide members so as to be guided, and the process cartridge B is detachably attachable to the printer main body 14.

The drum shutter member 18 is automatically opened and closed in conjunction with the detaching and attaching operation of the process cartridge B. That is, the drum shutter member 18 is kept in an open state where the drum shutter member 18 escapes from the transfer opening portion 13*n* as shown in FIG. 1 when the process cartridge B is attached to the printer main body 14, and when the process cartridge B is extracted from the printer main body 14, the drum shutter member 18 is held in a close state where the process cartridge B is moved at a position where the process cartridge B covers the transfer opening portion 13*n* as indicated by a solid line of FIG. 3.

The process cartridge B is mechanically and electrically coupled to the printer main body 14 side in a predetermined state when the process cartridge B is attached to the printer main body 14 in a predetermined state.

Next, the structure of a main portion according to this embodiment will be described in more detail.

First, the structure of the electrifying means will be described. The electrifying process according to this embodiment is conducted by an injection electrifying device where the electrifying roller 8 is covered with the charge accelerating particles.

The electrifying roller 8 is an elastic roller having conductivity, and an intermediate-resistant layer made of a rubber or a foaming plastic member (flexible member, elastic member) is formed on a metal core in the form of a roller. The intermediate-resistant layer is made of a resin (for example, urethane), conductive particles (for example, carbon black), a sulphidizing agent, a foaming agent or the like.

Also, the charge accelerating particles are conductive zinc oxide having an average diameter including secondary aggregate of 3 $\mu$m and a specific resistance of $10^6\Omega$.cm. The polarity of the charge accelerating particles is positive which is opposite to the electrifying polarity of the toner which is negative. The charge accelerating particles may be made of conductive inorganic particles including other metal compounds, or various conductive particles including mixed material with organic material.

Figure 6:
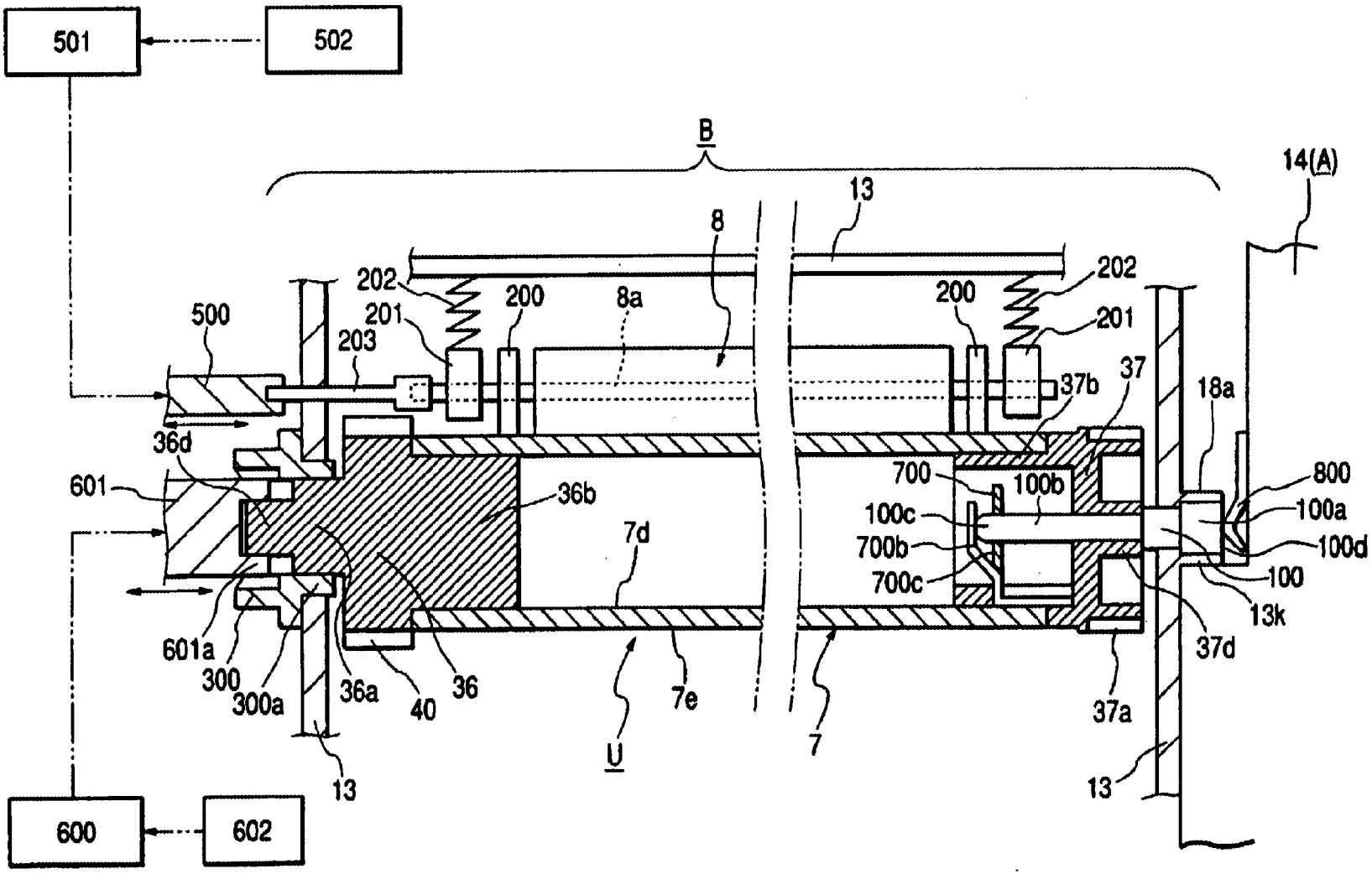
FIG. 6 is a schematic explanatory diagram showing the support structure and the drive structure of an electrifying roller and a photosensitive member drum.
Figure 7:
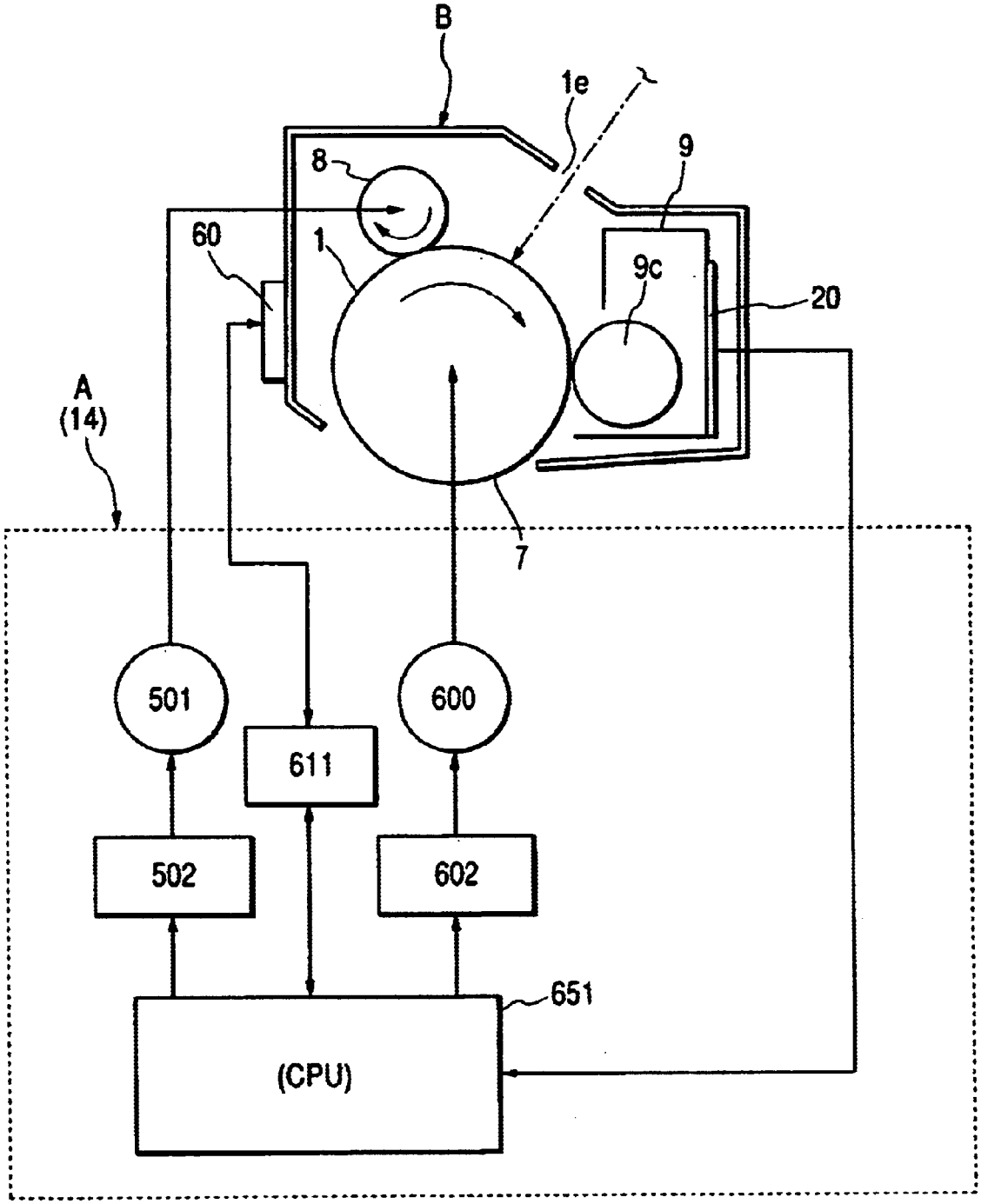
FIG. 7 is a schematic explanatory diagram showing a control system.

Next, the support and drive structure of the photosensitive member drum 1 and the electrifying roller 8 and the control system thereof will be described with reference to FIGS. 6 and 7. FIG. 6 is a schematic explanatory diagram showing the support structure and the drive structure of the electrifying roller 8 and the photosensitive member drum 7, and FIG. 7 is a schematic diagram showing the control system.

Cylindrical collision members 200 are rotatably disposed on both ends of the core 8*a* of the electrifying roller 8 so as to maintain the distance between the photosensitive member drum 7 and the core 8*a* to be constant. The collision members 200 are so set as to be smaller in radius than the electrifying roller 8, and set to be smaller in the radius than the electrifying roller 8 by about 0.2 mm in this embodiment.

Also, the electrifying roller 8 is rotatably supported by a bearing 201 that is swingably disposed on the drum frame 13. In more detail, the bearing 201 that is made of a sliding property resin (for example, polyacetate) is fitted to the guide portion 13*a* (FIG. 3) disposed on the drum frame 13, and a compression coil spring 202 for giving an urging force in a direction along which the electrifying roller 8 is in pressure contact with the photosensitive member drum 7 is disposed on the bearing 201.

On the other hand, a coupling member 203 is disposed on one end portion of the core 8*a* of the electrifying roller 8 in a longitudinal direction thereof so as not to be rotatable with respect to the core 8*a*. The coupling member 203 is coupled to a second drive transmission shaft 500 disposed on the printer main body 14 to transmit the drive force.

The second drive transmission shaft 500 is rotatable in a peripheral direction and swingable in an axial direction in conjunction with the open/close operation of the above-mentioned printer main body open/close member 35 (FIG. 1). When the process cartridge B is attached to the printer main body 14 and the open/close member 35 is closed, the second drive transmission shaft 500 is projected and coupled to the coupling member 203. When the open/close member 35 is opened, the second drive transmission shaft 500 moves backward in a direction opposite to the above projecting direction, and the coupling of the second drive transmission shaft 500 to the coupling member 203 is released, thereby providing the capability of extracting the process cartridge B. As a method of bringing the second drive transmission shaft 500 in conjunction with the open/close operation of the open/close member 35, a lever or the like may be disposed on the open/close member 35.

A drive force is transmitted to the second drive transmission shaft 500 from a second drive motor (second drive means) 501 that functions as a drive force through a gear or the like (not shown). Also, the second drive motor 501 is connected to a second drive control means (motor driver) 502, and the rotation speed of the electrifying roller 8 is controlled on the basis of the information from a calculation control means (CPU) 651 (FIG. 7).

Next, the photosensitive member drum unit U and the drive structure of the photosensitive member drum unit U will be described. The photosensitive member drum 7 according to this embodiment is structured by coating an organic photoconductive layer 7*e* on the outer side of an aluminum cylinder, and is rotatably supported by the drum frame 13.

The electrifying roller 8 is disposed on the periphery of the photosensitive member drum 7 so as to uniformly electrify the surface of the photosensitive member drum 7. The drive force of the first drive motor (first drive means) 600 disposed on the printer main body 14 is transmitted to the photosensitive member drum 7, and the drive force of the second drive motor (second drive means) 501 is transmitted to the electrifying roller 8 as described above, to thereby rotate the photosensitive member drum 7 and the electrifying roller 8 in accordance with the image forming operation, respectively.

The first drive motor 600 is connected to a first drive control means (motor driver) 602.

A drum flange 36 is fixed to one end of the photosensitive member drum 7 in the axial direction. The photosensitive member drum 7 and the drum flange 36 are fixed by fittingly inserting an insertion outer diameter portion 36*b* disposed on the drum flange 36 into an inner diameter 7*d* of the photosensitive member drum 7, and bending the end portion of the photosensitive member drum 7 into a concave portion (not shown) disposed in the drum flange 36.

A gear portion 40 is disposed on the drum flange 36. The gear portion 40 is meshed with a developing roller gear (not shown), disposed on the developing roller 9*c*, for rotatably driving the developing roller 9*c* to transmit the drive force to the developing roller 9*c*.

Also, a shaft portion 36*a* is disposed on the drum flange 36 and fittingly inserted into an insertion inner diameter portion 300*a* of the bearing member 300 disposed on the drum frame 13 so as to be pivotally supported.

In addition, a convex portion 36*d* is formed in the drum flange 36 as a drive force receiving-portion for receiving the drive force from the printer main body 14. The convex portion 36*d* is fittingly inserted into the concave portion 601*a* of the first drive transmission shaft 601 disposed on the printer main body 14 to transmit the drive force.

The first drive transmission shaft 601 is rotatable in the peripheral direction and swingable in the axial direction in conjunction with the open/close operation of the printer main body open/close member 35 (FIG. 1), just like the second drive transmission shaft 500 described above. When the process cartridge B is attached to the printer main body 14 and the open/close member 35 is closed, the first drive transmission shaft 601 is projected. When the first drive transmission shaft 601 is coupled to the convex portion 36*d* and the open/close member 35 is opened, the first drive transmission shaft 601 moves backward in a direction opposite to the projecting direction, and the coupling of the first drive transmission shaft 601 to the convex portion 36*d* is released, thereby providing the capability of extracting the process cartridge B.

A drive force is transmitted to the first drive transmission shaft 601 from the first drive motor 600 that functions as a drive source through a gear (not shown) or the like.

A drum flange 37 is fixed to another end portion of the photosensitive member drum 7 in the axial direction.

As a fixing method, just like the drum flange 36, the photosensitive member drum 7 and the drum flange 37 are fixed by fittingly inserting an insertion outer diameter portion 37*b* disposed on the drum flange 37 into an inner diameter 7*d* of the photosensitive member drum 7, and bending the end portion of the photosensitive member drum 7 into a concave portion (not shown) disposed in the drum flange 37.

A gear 37*a* is disposed on the drum flange 37 and is meshed with a transferring roller gear (not shown) disposed on the transferring roller 4 to transmit the drive force to the transferring roller 4. Therefore, the transferring roller 4 is rotationally driven in response to the rotation of the photosensitive member drum 7.

Also, an insertion hole 37*d* is formed in the drum flange 37 and pivotally supported by a shaft portion 100*b* of the drum shaft 100 disposed on the drum frame 13. The drum shaft 100 is fixed by press-inserting the outer diameter portion 100*a* into a press-insertion inner diameter 13*k* formed in the drum frame 13.

In addition, a drum earth contact 700 is disposed on the drum flange 37. The drum earth contact 700 is made of a conductive material (for example, copper alloy, SUS, etc.), and fixed to a drum earth contact fitting portion (not shown) disposed on the drum flange 37 due to heat fusion or the like.

The drum earth contact 700 has first contact portions (not shown) at two positions on the outer periphery of a substrate 700*c* formed substantially in the form of a disk, and a second contact portion 700*b* at the middle position between the first contact portions.

Then, the first contact portions are in pressure contact with the inner diameter portion 7*d* of the photosensitive member drum 7 and arranged at the outer diameter portion of the insertion hole portion 37*d* so that the second contact portion 700*b* is in elastic contact with a leading surface 100*c* of the drum shaft 100, to thereby electrically connect the photosensitive member drum 7 and the drum shaft 100.

A contact member 800 is disposed in the printer main body 14, and when the process cartridge B is attached to the printer main body 14, the contact member 800 is electrically connected to the end surface 100*d* of the drum shaft 100, thereby providing the capability of grounding the photosensitive member drum 7.

The drum flanges 36 and 37 may be made of a resin material excellent in sliding property such as polyacetal, polycarbonate, polyamide or polybutylenetelephthalate, to thereby enable smooth drive transmission without any noises and vibrations. However, other materials having the same effects may be appropriately selected for use.

(2) Toner Remaining Amount Detection Means 20

In the above injection electrifying system, there may occur the deterioration of electrifying performance, and more specifically, the deterioration of electrifying uniformity due to long-period use. This is mainly caused by a reduction in a contact area of the charge accelerating particles with the photosensitive member drum 7 due to the toner that is an insulator and has been stored on the electrifying roller 8 bit by bit.

In this embodiment, the electrifying property is maintained by increasing the contact opportunities of the charge accelerating particles with the photosensitive member drum 7. In more detail, the remaining amount of toner within the toner container 11A of the developing means 9 is detected by a toner amount detection means 20 (FIG. 7), and the rotation speed of the electrifying roller 8 is changed in accordance with the detected toner remaining amount and the peripheral speeds of the photosensitive member drum 7 and the electrifying member 8 are variably changed under control. Alternatively, taking the remaining amount of toner and the lifetime of the photosensitive member drum 7 into consideration, the rotation speed of the electrifying roller 8 is changed and the peripheral speeds of the photosensitive member drum 7 and the electrifying member 8 are variably changed under control.

The calculation control means (CPU) may calculate the consumed toner amount on the basis of the detected toner remaining amount to change the rotation speed of the electrifying roller 8 in accordance with the calculated consumed toner amount and variably control the peripheral speeds of the photosensitive member drum 7 and the electrifying member 8.

Figure 8:
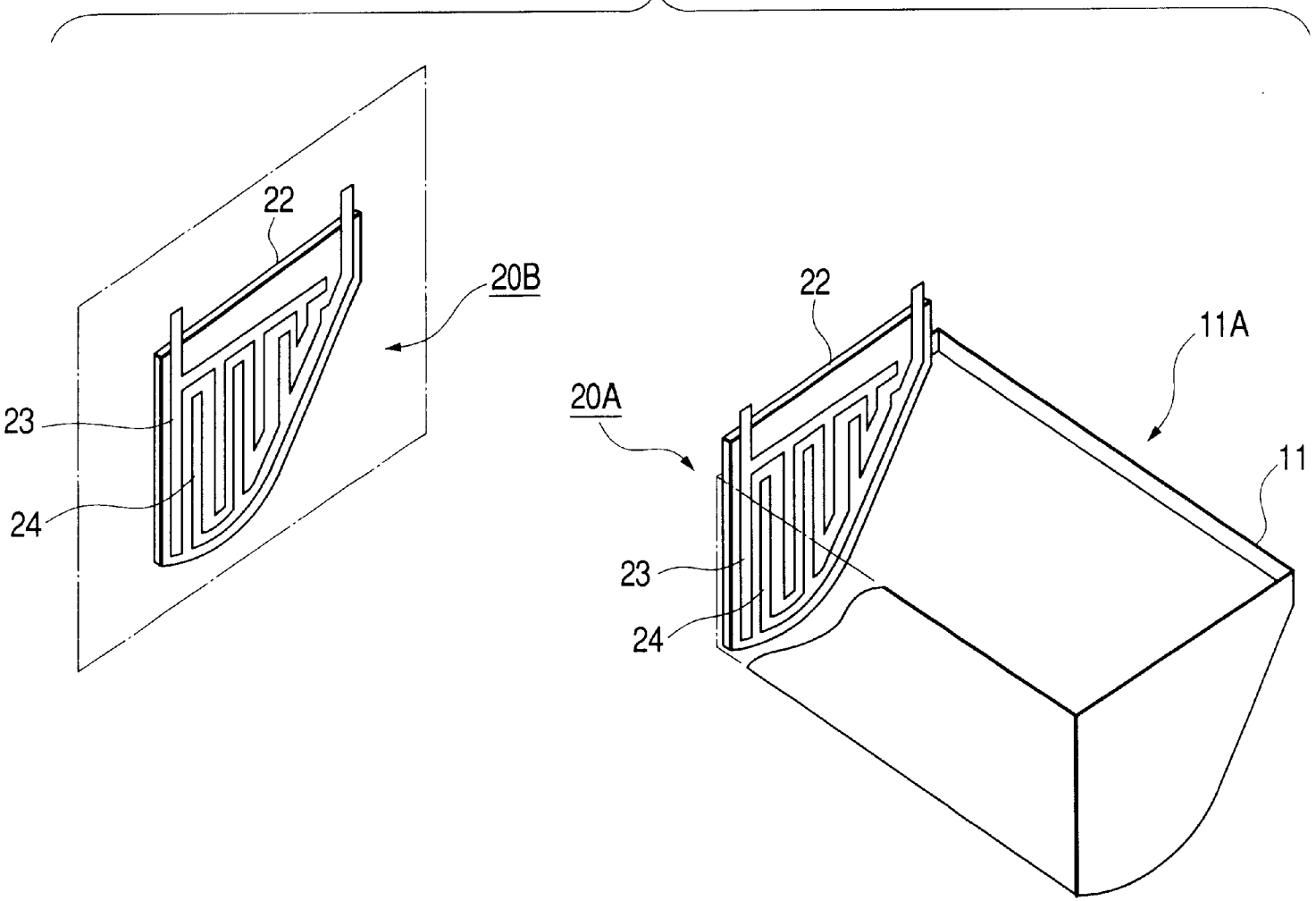
FIG. 8 is a partially-cut away perspective view showing a toner container for explaining a toner amount detecting apparatus according to the present invention.
Figure 9:
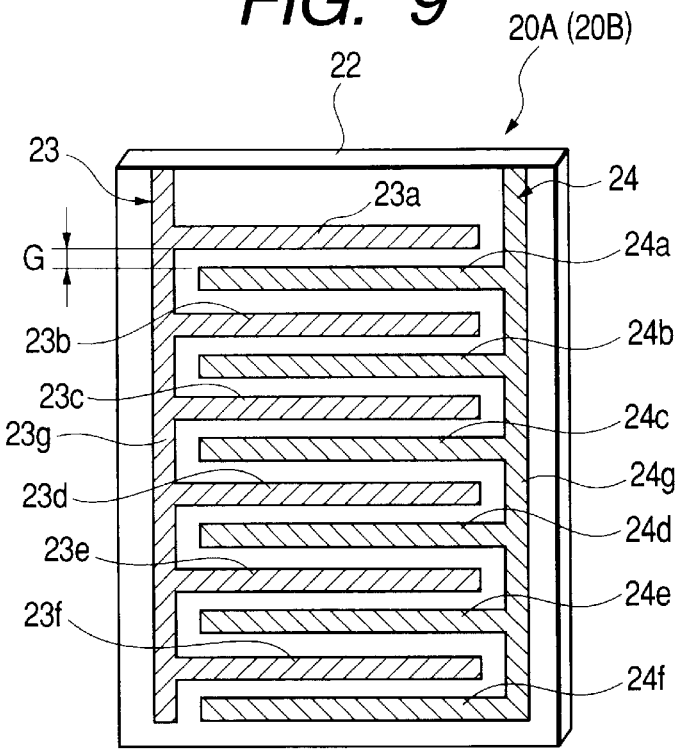
FIG. 9 is a front view showing a measurement electrode member and a reference electrode member in accordance with an embodiment of the present invention.
Figure 10:
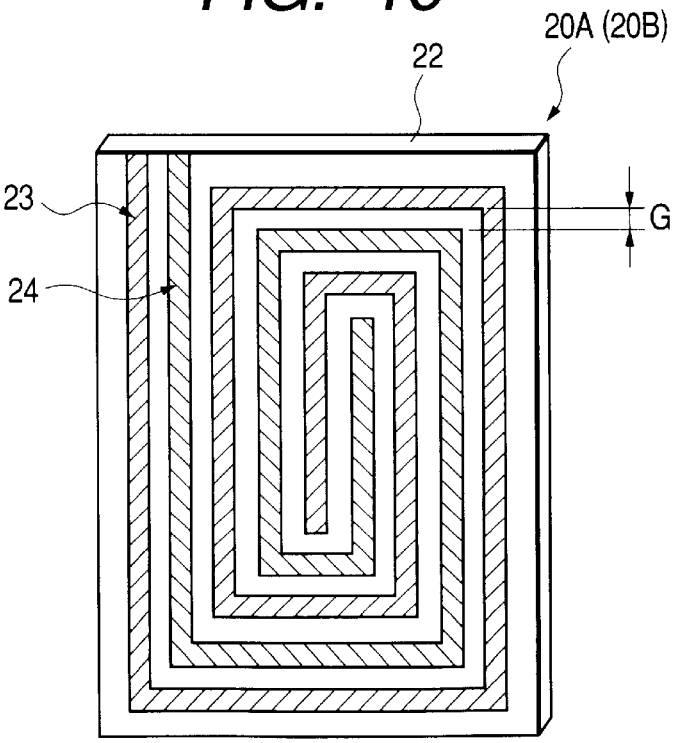
FIG. 10 is a front view showing a measurement electrode member and a reference electrode member in accordance with another embodiment of the present invention.

FIGS. 8, 9 and 10 show the toner remaining amount detection means for detecting the remaining amount of toner that is usable for development within the toner container 11A.

FIG. 8 is a partially-cut away perspective view showing the toner container for explaining the toner amount detection means 20 in accordance with the present invention. FIG. 9 is a front view showing a measurement electrode member and a reference electrode member in accordance with an embodiment. FIG. 10 is a front view showing a measurement electrode member and a reference electrode member in accordance with another embodiment.

The detection means 20 for detecting the amount of toner is so designed as to detect the amount of toner within the toner container 11A of the developing means 9, and includes, in this embodiment, a measurement electrode member 20A that detects the amount of toner, and a reference electrode member 20B that functions as a comparative member which detects parameters of the environment, that is, the temperature and humidity of the atmosphere to output a reference signal.

The measurement electrode member 20A is arranged at a position where the measurement electrode member 20A is in contact with the toner on the inner side surface or the bottom surface of the toner container 11A of the developing means 9 and in a direction along which the contact area of the measurement electrode member 20A with the toner changes as the amount of toner in the toner container 11A is reduced, for example, as shown in FIG. 8.

Also, the reference electrode member 20B can be provided at a position which is within the toner container 11A at the same side as that where the measurement electrode member 20A is arranged and which is out of contact with the toner.

The measurement electrode member 20A and the reference electrode member 20B have a pair of electrodes that are formed on the substrate 22 in parallel with each other at a predetermined interval, that is, an input side electrode 23 and an output side electrode 24.

In this embodiment, as shown in FIG. 9, the electrodes 23 and 24 have at least one pair of electrode portions 23*a* to 23*f* and 24*a* to 24*f* which are disposed in parallel with each other at a predetermined interval G, and the respective electrode portions 23*a* to 23*f* and 24*a* to 24*f* are coupled to each other by coupling electrode portions 23*g* and 24*g*, and the two electrodes 23 and 24 are shaped in multiple concave and convex portions which are combined with each other.

It is needless to say that the electrode pattern of the measurement electrode member 20 is not limited to the above structure, but as shown in FIG. 10, a pair of electrodes 23 and 24 may be arranged in parallel with each other at a predetermined interval in the form of a spiral.

The above-mentioned toner amount detection means 20 measures a change in the contact area of toner with respect to the measurement electrode member 20A that is located in a direction along which the toner on the inner side surface or bottom surface of the toner container 11A decreases, that is, means 20 measures a change in the electrostatic capacity of the measurement electrode member 20A, and sequentially detects the amount of toner within the entire toner container 11A in accordance with the measured value. The detection of the amount of toner is conducted by the calculation control means 651 on the basis of information on the change in the electrostatic capacity which is inputted to the calculation control means 651 from the toner amount detection means 20.

That is, because the dielectric constant of the toner is larger than air, a portion of the measurement electrode member 20A which is in contact with the toner (a portion at which the toner exists) is larger in the outputted electrostatic capacity than a portion of the measurement electrode member 20A which is out of contact with the toner (a portion at which no toner exists). Therefore, if a change in the electrostatic capacity is measured, a change in the amount of toner within the toner container 11A can be presumed.

The reference electrode member 20B has a pair of input side electrodes 23 (23*a* to 23*f*) and output side electrodes 24 (24*a* to 24*f*) which are formed on the substrate 22 in parallel with each other at a predetermined interval G, and is shaped in multiple concave and convex portions which combine those two electrodes 23 and 24 with each other as shown in FIG. 9, as in the above-mentioned measurement electrode member 20A. Alternatively, the reference electrode member 20B can be formed in the form of a spiral as shown in FIG. 10.

The reference electrode member 20B functions as a comparative member for reference with respect to the measurement electrode member 20A because the reference electrode member 20B cancels a variation in the electrostatic capacity of the electrode member which is caused by environmental conditions such as temperature or humidity.

That is, the output of the measurement electrode member 20A is compared with the output of the reference electrode member 20B which varies due to a change in the environment. For example, when a predetermined electrostatic capacity of the reference electrode member 20B is set to the same value as that of the measurement electrode member 20A at the time when no toner exists to take a difference between the outputs of the reference electrode member 20B and the measurement electrode member 20A, because the output of only the change in the electrostatic capacity due to the toner can be obtained, the precision in the detection of the toner remaining amount can be enhanced.

Because the measurement electrode member 20A measures the electrostatic capacity of the contact portion of the pattern surface and presumes the amount of toner within the toner container 11A, the presumed amount of toner varies due to a change in the environment (humidity, temperature or the like). For example, when the humidity becomes higher, since the amount of steam in the air becomes larger, the dielectric constant of the atmosphere that is in contact with the detecting member 20A also increases. For that reason, even in the case where the same amount of toner is applied, when the environment changes, the output from the measurement electrode member 20A also changes. Also, in the case where the substrate 22 that forms the pattern is made of a moisture absorbent material, because the dielectric constant of the substrate 22 changes due to moisture absorption, the substrate 22 varies due to the environment.

For that reason, the reference electrode member 20B that functions as the comparative member that varies due to the environment as in the measurement electrode member 20A, that is, for example, the reference electrode member 20B that is identical in structure with the measurement electrode member 20A and is out of contact with the toner is located under the same environment as those of the measurement electrode member 20A, and both outputs of the reference electrode member 20B and the measurement electrode member 20A are compared with each other, and a difference between those outputs is taken to cancel the environmental variation, thereby providing the capability of measuring the remaining amount of toner without being affected by the environmental variation.

Also, as described above, in this embodiment, the toner container 11A is provided with the measurement electrode member 20A for sequentially detecting the remaining amount of toner and the reference electrode member 20B. As the detection means 20 for detecting the amount of toner, more preferably, an antenna bar, that is, an electrode bar (FIG. 3) is disposed in the developing means 9 so as to extend at a predetermined interval from the developing roller 9*c* in the longitudinal direction of the developing roller 9*c* by a predetermined length.

With this structure, a change in the electrostatic capacity between the developing roller 9*c* and the electrode bar is detected, thereby providing the capability of detecting the toner end.

As described above, the toner amount detection means 20 according to the present invention utilizes the electrostatic capacity, however, the toner surface may be mechanically detected to sequentially detect the remaining amount of toner as disclosed in Japanese Patent Application Laid-open No. 11-282239.

(3) Storage Means 60

Figure 14:
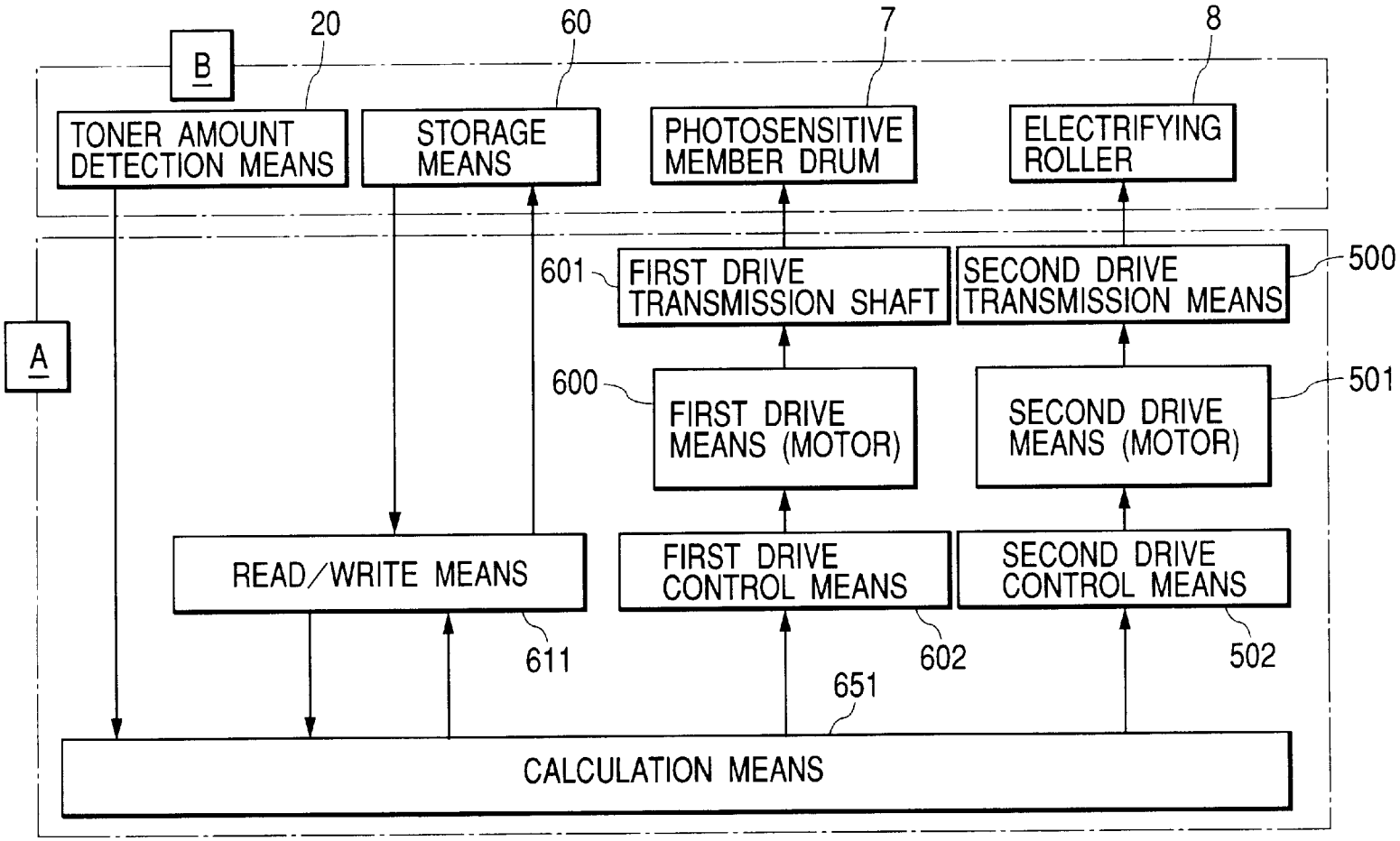
FIG. 14 is a block diagram showing an electrophotographic image forming apparatus and a process cartridge according to the present invention.

In FIGS. 3, 7 and 14, reference numeral 60 denotes a storage means that is disposed on the process cartridge B side. Information is transmitted between the storage means 60 and the calculation control means 651 on the printer main body 14 side through a read/write means 611.

The nonvolatile storage means 60 used in the present invention is not particularly restricted if the storage means 60 reloadably stores and saves signal information, and may be formed of, for example, a RAM, an electrical storage means such as a reloadable ROM, or a magnetic storage means such as a magnetic recording medium, a magnetic bubble memory, or a magneto-optical memory.

In this embodiment, an NV (nonvolatile) RAM is used as the nonvolatile storing memory 60 from the viewpoints of the handling facility and the costs. There are written, in the storage means 60, data maps related to the appropriate rotation speed of the electrifying roller 8 in accordance with the amount of toner that remains in the process cartridge B or information (the consumed amount of toner, the remaining amount of toner) related to the amount of toner obtained from the toner amount detection means 20 and information on the abrasive sliding distance L of the photosensitive member drum 7 and the electrifying roller 8.

Writing is conducted at a timing when a given amount of toner has been consumed, a timing when a given amount of recording medium 2 has been printed, or a timing when a given amount of abrasive sliding distance L has occurred.

(4) Rotation Speed Control of the Electrifying Roller 8

In this embodiment, the electrifying roller rotation speed stored in the storage means 60 in advance is accessed when the amount of toner within the toner container 11A of the developing means 9 reaches a predetermined remaining amount of toner, and the electrifying roller rotation speed is changed in accordance with the electrifying roller maximum rotation speed.

Figure 11:
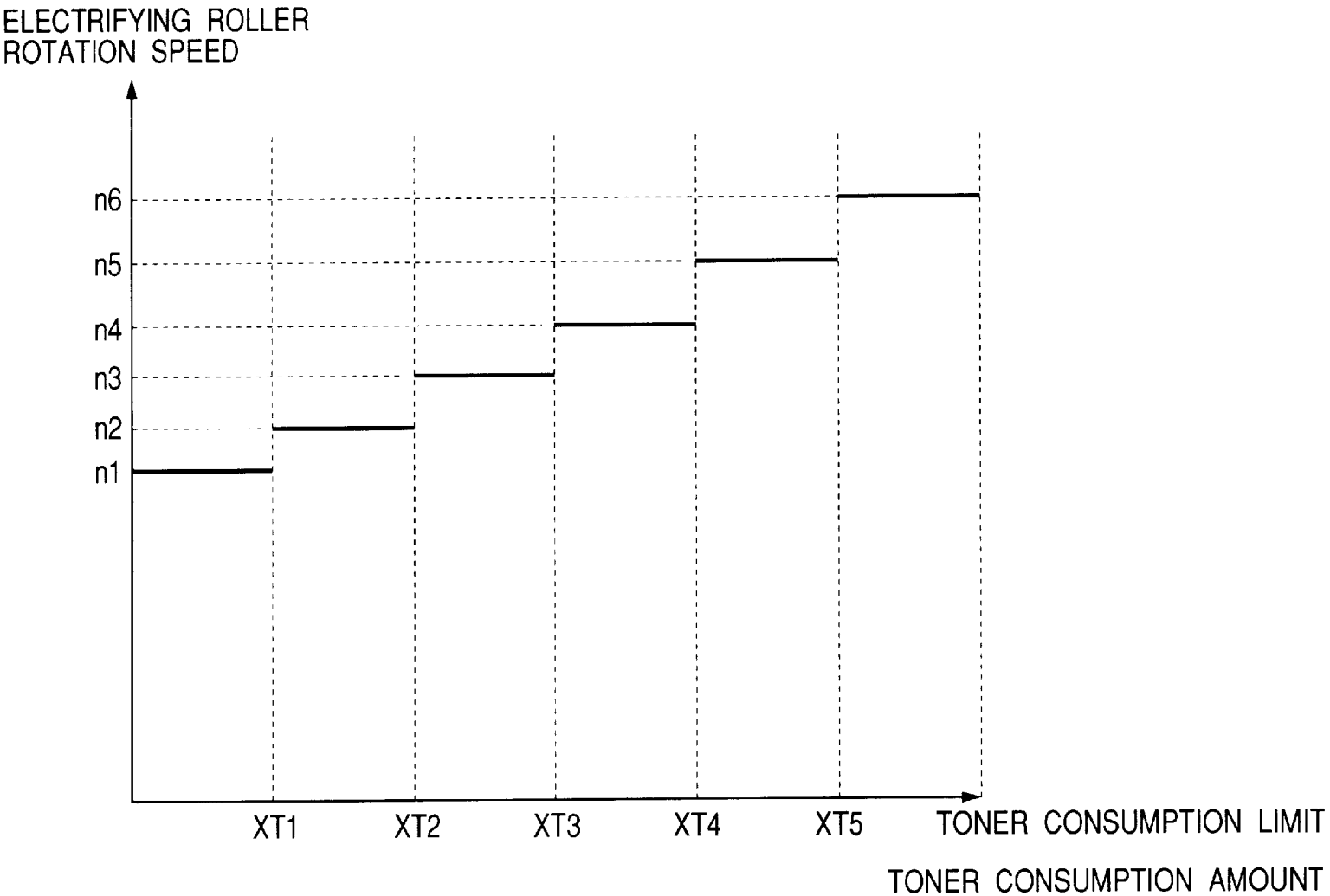
FIG. 11 is a diagram for explanation of an electrifying roller rotation speed changing method in accordance with a first embodiment.

FIG. 11 shows a relation between the amount of toner and the electrifying roller rotation speed.

The electrifying roller 8 is rotated at an initial rotation speed n1 since the amount of remaining toner is between the amount of toner in an unused state of the process cartridge B and a predetermined amount of remaining toner. The initial rotation speed is also stored in the storage means 60.

The calculation control means 651 sequentially or periodically detects the consumed amount of toner by the above-mentioned toner amount detection means 20, and controls the driving of the second drive motor 501 by the second drive control means 502 so that the rotation speed of the electrifying roller 8 continues the initial rotation speed n1 until a specified amount XT1 has been consumed.

At the time point of XT1, the optimum rotation speed n2 subsequent to XT1 is accessed from the storage means 60, and the electrifying roller 8 is driven at the rotation speed n2.

Similarly, at the time period of from XT1 to XT2, the electrifying roller 8 is driven at the rotation speed n2, and after the time point of XT2, a succeeding optimum rotation speed n3 is accessed from the storage means 60 to change the rotation speed.

The electrifying roller rotation speed can be set to an optimum value up to the toner consumption limit by repeating the above procedure. That is, the electrifying property is maintained by increasing the contact opportunities of the charge accelerating particles with the photosensitive member drum 7.

The storage means 60 may be attached to the image forming apparatus main body, or may be attached to each of the process cartridges.

In the case where the storage means 60 is disposed in each of the process cartridges B, when the conditions are going to change after production starts, for example, when a new high-performance material is found out and parts are going to change, there is the possibility that such a change is accommodated by only a change in the data map without changing the image forming apparatus main body.

(Second Embodiment)

In this embodiment, not only the consumed amount of toner according to the above-mentioned first embodiment but also the abrasive sliding distance between the photosensitive member drum 7 and the electrifying roller 8 are used as parameters of the rotation speed control of the electrifying roller 8. That is, an accumulated distance by which the photosensitive member drum 1 and the electrifying roller 8 abrasively slide is written in the storage means 60, and when the amount of toner within the toner container 11A of the developing means 9 reaches a predetermined remaining amount of toner, the electrifying roller optimum number of times according to the abrasive sliding distance is accessed, and the electrifying roller rotation speed is changed in accordance with the accessed number of times. The lifetime margin of the photosensitive member drum 7 can be effectively used as a margin for electrifying uniformity by taking the abrasive sliding distance into consideration.

Figure 12:
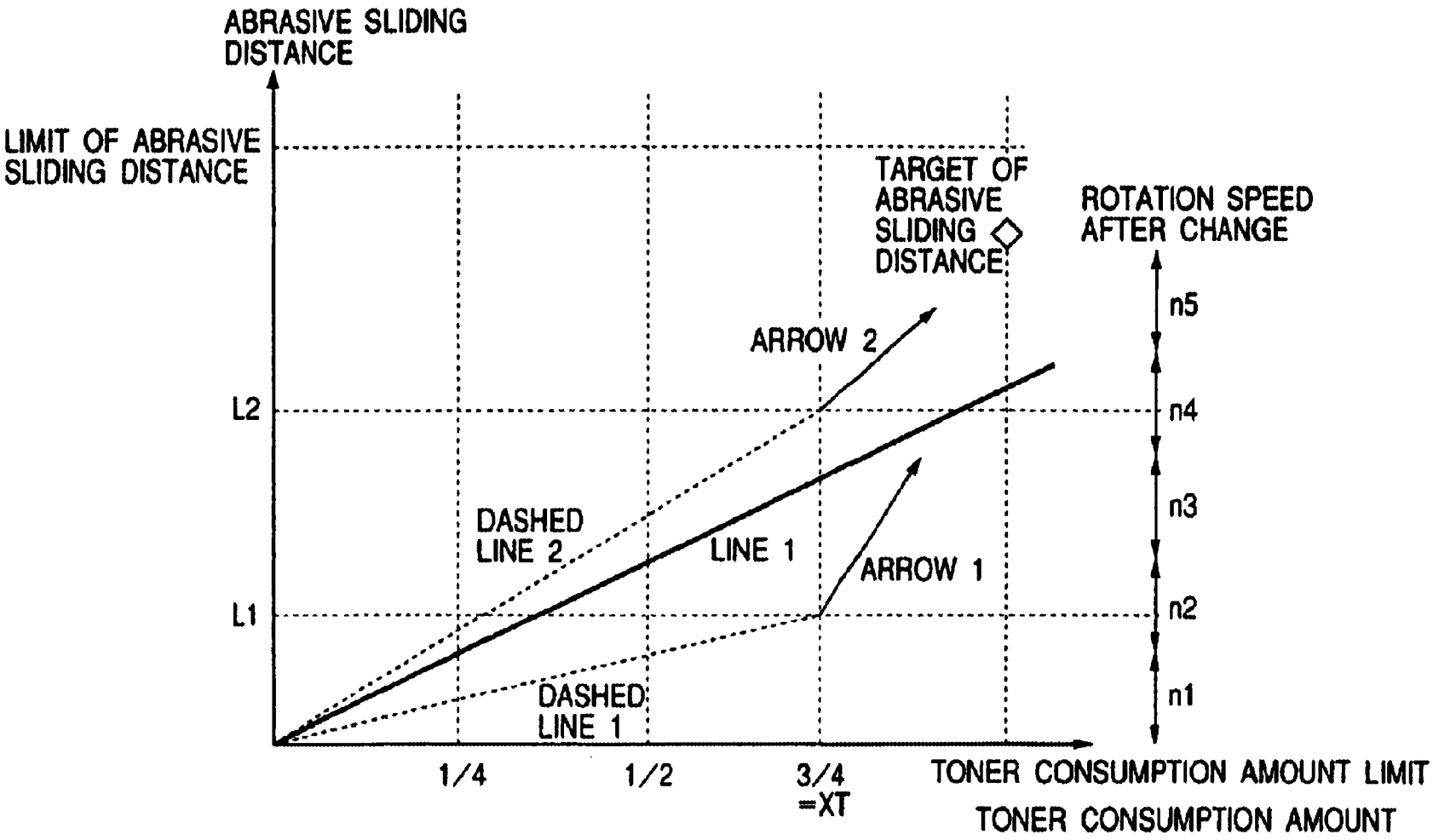
FIG. 12 is a diagram for explanation of an electrifying roller rotation speed changing method in accordance with a second embodiment of the present invention.

A method of changing the rotation speed of the electrifying roller according to this embodiment will be described with reference to FIG. 12. FIG. 12 is a graph showing a relationship of the consumed amount of toner, the abrasive sliding distance and the peripheral speed difference under the control according to this embodiment.

First, the graph showing a relationship of the amount of toner, the abrasive sliding distance and the peripheral speed difference shown in FIG. 12 will be described. This shows a relationship of the consumed amount of toner and the abrasive sliding distance of the photographic drum 7 and the electrifying roller 8 in use of the process cartridge. The horizontal axis indicates the consumed amount of toner, and the vertical axis indicates the abrasive sliding distance.

a) The Abrasive Sliding Distance and the Drum Lifetime

In the charge injecting electrifying system according to the present invention, it is important to provide more contact opportunities of the charge accelerating particles and the photosensitive member drum 7, and in order to achieve this, the electrifying roller 8 and the photosensitive member drum 7 are rotationally driven in the same direction.

Assuming that the peripheral speed of the photosensitive member drum 7 surface is Va, and the peripheral speed of the electrifying roller 8 surface is Vb with respect to the contact surfaces of the photosensitive member drum 7 and the electrifying roller 8, the peripheral speed difference V between the photosensitive member drum 7 and the electrifying roller is represented by the following expression:

$$V=Va+Vb$$

There are many cases in which the peripheral speed Va of the photosensitive member drum 7 surface is constant, but there is a system that conducts multi-speed control of a so-called printing speed (peripheral speed Va of the photosensitive member drum 7) having a mode that makes the peripheral speed Va of the photosensitive member drum 7 low in order to record an image with a high resolution. In more detail, in FIG. 7, the rotation of the photosensitive member drum 7 that functions as an image bearing member is made by the first drive motor 600 that functions as the first drive means, and the rotation speed (peripheral speed) control of the photosensitive member drum 7 is made by controlling the first drive motor 600 using the first drive control means 601 under the control by the calculation control means 651.

The abrasive sliding distance L of the contact portion of the photosensitive member drum 7 with the electrifying roller 8 is represented by a product of the peripheral speed difference V and the rotation drive period T of the photosensitive member drum 7 and the electrifying roller 8 as follows:

$$L=V\times T$$

The abrasive sliding distance L is calculated by the calculation control means.

The lifetime of the photosensitive member drum 7 is determined by the scraping amount of the surface of the photosensitive member drum 7, and when the scraping amount has the linear relation with the abrasive sliding distance L, that is, when the abrasive sliding distance L reaches a given value LL (abrasive sliding limit), the lifetime of the photosensitive member drum 7 is ended. The abrasive sliding limit LL is stored in the storage means 60 of the process cartridge B in advance.

b) Read/write of the Consumed Amount of Toner X and the Abrasive Sliding Distance L The consumed amount of toner X and the abrasive sliding distance L are written/read in/from the storage means 60 of the process cartridge B through the read/write means 611 by the calculation control means 651 at a predetermined timing.

In this embodiment, a timing at which a predetermined amount of toner has been consumed (X1, X2, . . . ) is applied as the writing timing. At this timing, data related to the consumed amount of toner X and the abrasive sliding distance L is stored in the storage means 60 as a set. As other examples of the writing timing, a timing at which a predetermined amount of a recording medium 2 is printed thereon, or a timing at which a predetermined abrasive sliding distance L is consumed may be applied.

c) Desired Abrasive Sliding Distance

FIG. 12 shows a relationship between the consumed amount of toner and the abrasive sliding distance.

A line 1 is a line in the case where the toner is consumed at a standard printing ratio, and the electrifying roller rotation speed at the initial stage of the process cartridge continues. The vertical axis in FIG. 12 indicates an abrasive sliding limit distance. A difference between the abrasive sliding distance Ln of the line 1 and the abrasive sliding limit in the toner consumption limit is a margin related to the lifetime of the photosensitive member drum.

The desired abrasive sliding distance is set to a value closer to the abrasive sliding limit distance than Ln. The rotation speed of the electrifying roller is made high prior to the toner consumption limit, to thereby make the abrasive sliding distance approach the desired abrasive sliding distance.

d) Electrifying Roller Rotation Speed Changing Timing

The electrifying roller is driven at a predetermined rotation speed at the time of starting the use of the process cartridge. The possibility that the developer is stored in the electrifying roller occurs in the last half of the lifetime of the process cartridge B. In a method that is described in this example, a time point at which ¾ of the toner capacity has been consumed is set as a changing timing. The changing timing is not limited to this.

e) Electrifying Roller Rotation Speed

FIG. 12 shows a relation between the consumed amount of toner and the abrasive sliding distance in the case where the electrifying roller rotation speed is changed. Dashed lines 1 and 2 are examples of histories that have formed the respective different images.

The electrifying roller rotation speed is kept in an initial state until a rotation speed change point XT. However, a difference occurs in the abrasive sliding distance at the rotation speed change point XT in accordance with the image printing ratio.

The abrasive sliding distance at the rotation speed change point XT is read from the storage means 60, and the rotation speed corresponding to the abrasive sliding distance is accessed.

The rotation speed that approaches the desired abrasive sliding distance is recorded in the storage means 60.

In the example indicated by the dashed line 1 in FIG. 12, the abrasive sliding distance L1 is small at the time point of the rotation speed change point XT. The rotation speed n2 is selected from the storage means 60 in accordance with L1. The value n2 is larger than the rotation speed at the time of starting the use so as to approach the desired abrasive sliding distance.

The dashed line 1 is shifted toward a direction indicated by an arrow 1 by increasing the rotation speed.

In the dashed line 2, the abrasive sliding distance is larger than that in the dashed line 1. The change rotation speed given at the time of the rotation speed change is n5>n2 and approaches the desired abrasive sliding distance by increasing the rotation speed, similarly.

As described above, after a predetermined amount of toner has been consumed, the rotation speed of the electrifying roller 8 is increased in accordance with the abrasive sliding distance and the peripheral speeds of the photosensitive member drum 7 and the electrifying member 8 are variably changed, thereby providing the capability of maintaining the electrifying property over long-period usage.

(Third Embodiment)

Figure 13:
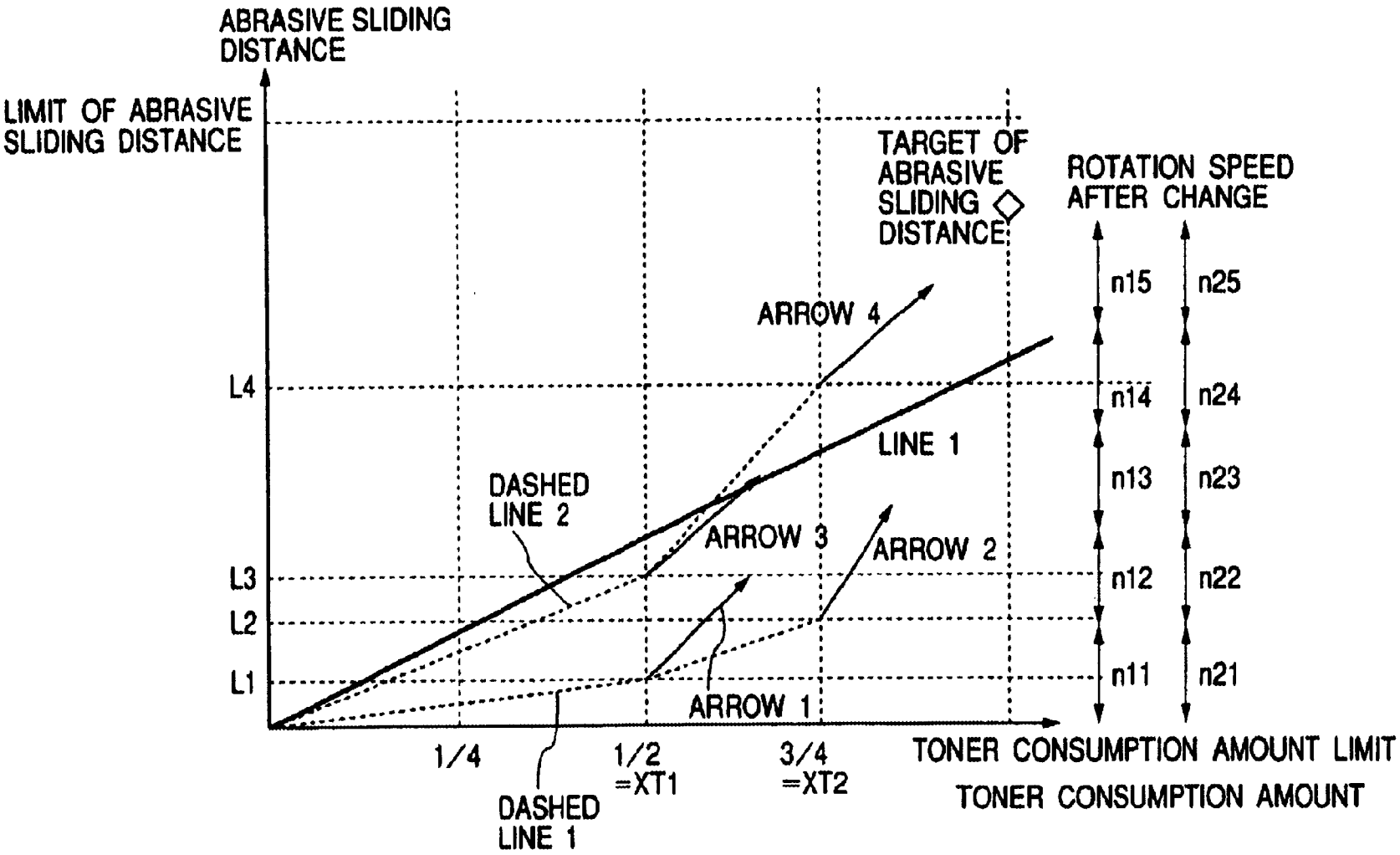
FIG. 13 is a diagram for explanation of an electrifying roller rotation speed changing method in accordance with a third embodiment.

FIG. 13 is a graph showing a relationship between the consumed amount of toner and the abrasive sliding distance for explanation of this embodiment. In this embodiment, a finer control method is applied.

In this embodiment, the electrifying roller rotation speed is so adapted as to keep the electrifying uniformity while the process cartridge B is close to the end of its lifetime. In this embodiment, a description will be given of an example in which a high electrifying property is exhibited over a longer period of time by changing the electrifying roller rotation speed plural times.

In this embodiment, two changes are conducted at a timing XT1 when the consumed amount of toner is ½ and at a timing XT2 when the consumed amount of toner is ¾. The number of times to change the speed is not limited to two.

Dashed lines 1 and 2 represent examples of histories where the respective different images have been printed.

In the dashed line 1, the rotation speed is changed to n11 at the electrifying roller rotation speed change point XT1 as in the first embodiment. The remaining amount of toner after the rotation speed has been changed is large, and thereafter when image formation is repeated at a printing ratio that is considerably different from that before the rotation speed is changed, there arises the possibility that a displacement of the abrasive sliding distance from the desired abrasive sliding distance becomes large.

However, the electrifying roller rotation speed is again changed at the time where a predetermined amount of toner has been consumed (XT2) so that the abrasive sliding distance can approach the desired abrasive sliding distance again.

As described above, since the rotation speed change of the electrifying roller 8 is conducted at multiple stages, long-period maintenance of the process cartridge electrifying property can be made by effectively using the margin of the photosensitive member drum 7 not depending on the printing ratio or a variation in the number of sheets that are continuously printed.

A timing at which the history data is saved is set every time the above-mentioned parameter is consumed in a predetermined amount, but it is unnecessary to limit the parameter to the predetermined amount.

(Fourth Embodiment)

In the above-mentioned first to third embodiments, only the data of the electrifying roller rotation speed is recorded in the storage means 60. In this embodiment, how a user has used the process cartridge B is recorded for the lifetime of the process cartridge. The recorded contents include the histories of the abrasive sliding distance and the remaining amount of toner.

A method of controlling the rotation speed of the electrifying roller 8 according to this embodiment will be described with reference to FIGS. 14–18.

Figure 15:
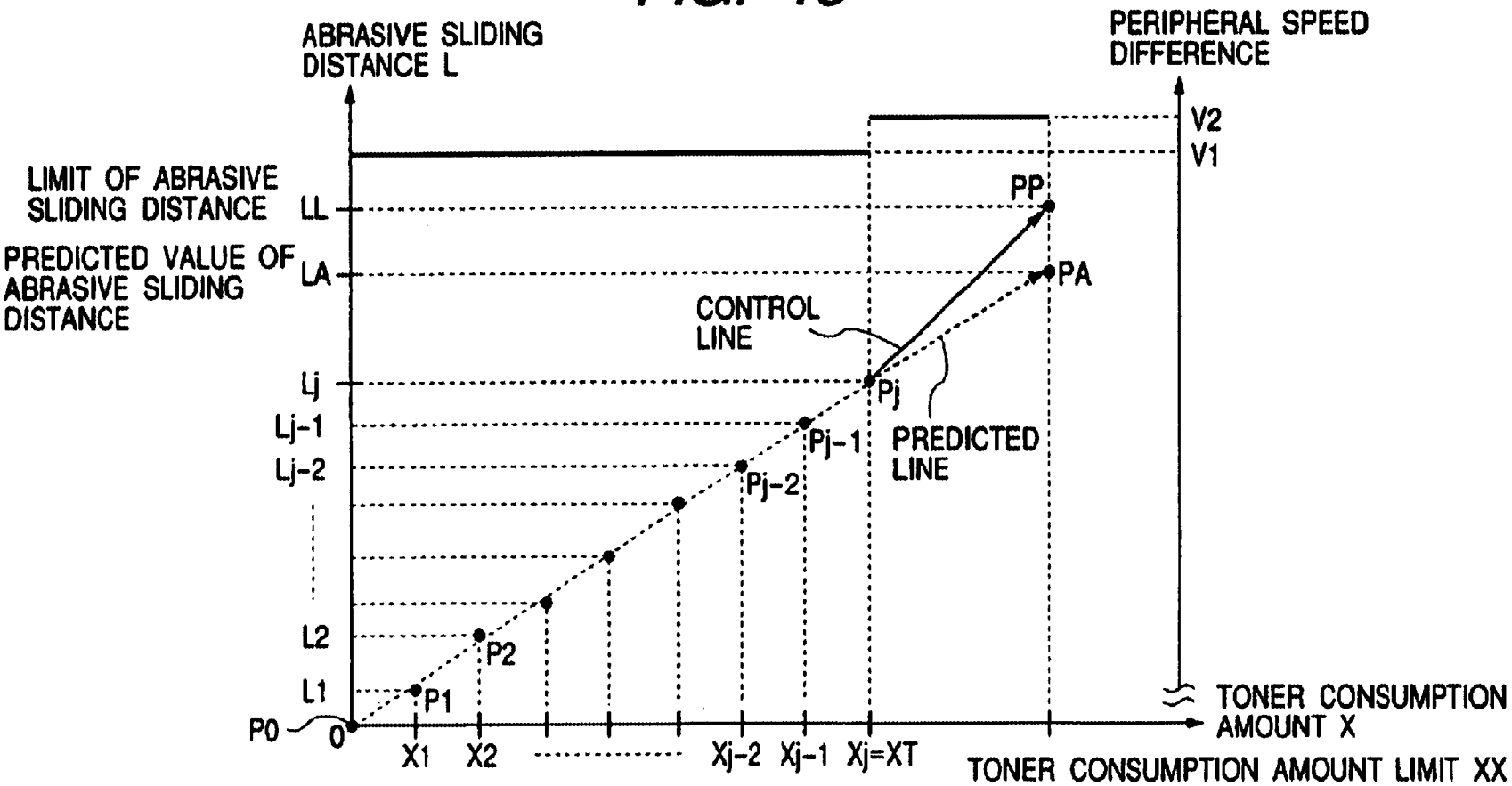
FIG. 15 is a diagram for explanation of an electrifying roller rotation speed changing method in accordance with a fourth embodiment.
Figure 16:
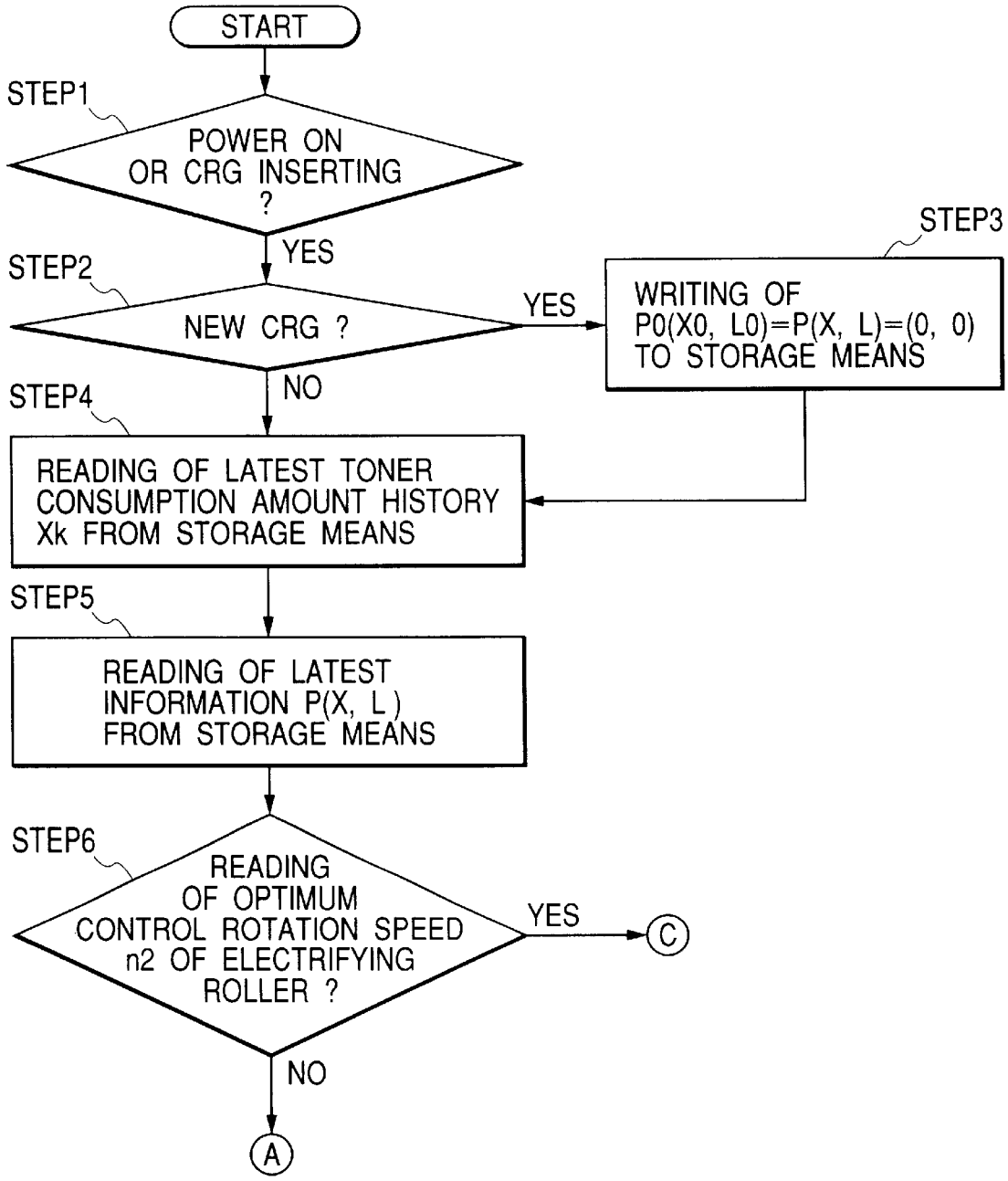
FIG. 16 is a first flowchart for explanation of a control method in accordance with the fourth embodiment.
Figure 17:
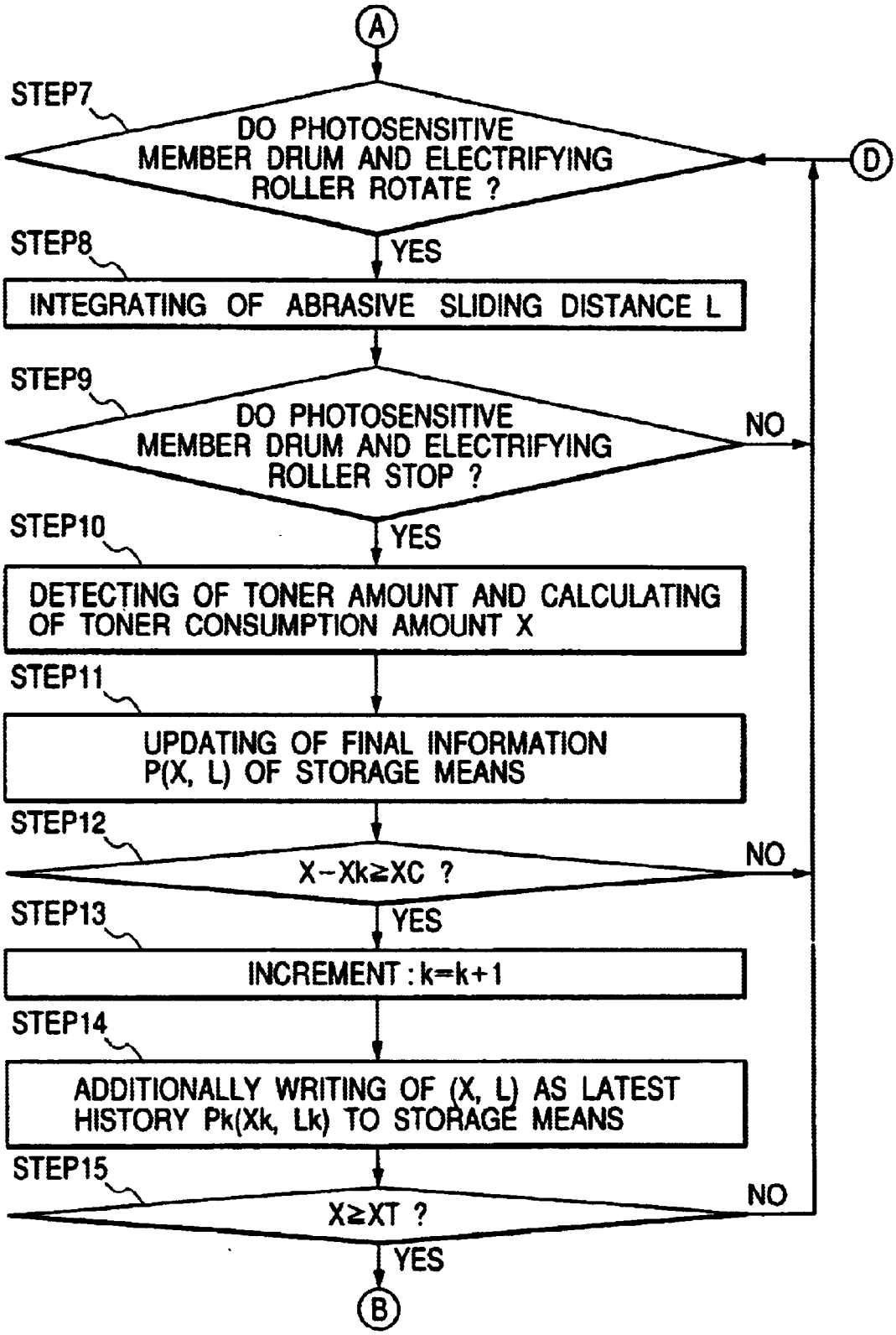
FIG. 17 is a second flowchart for explanation of a control method in accordance with the fourth embodiment.
Figure 18:
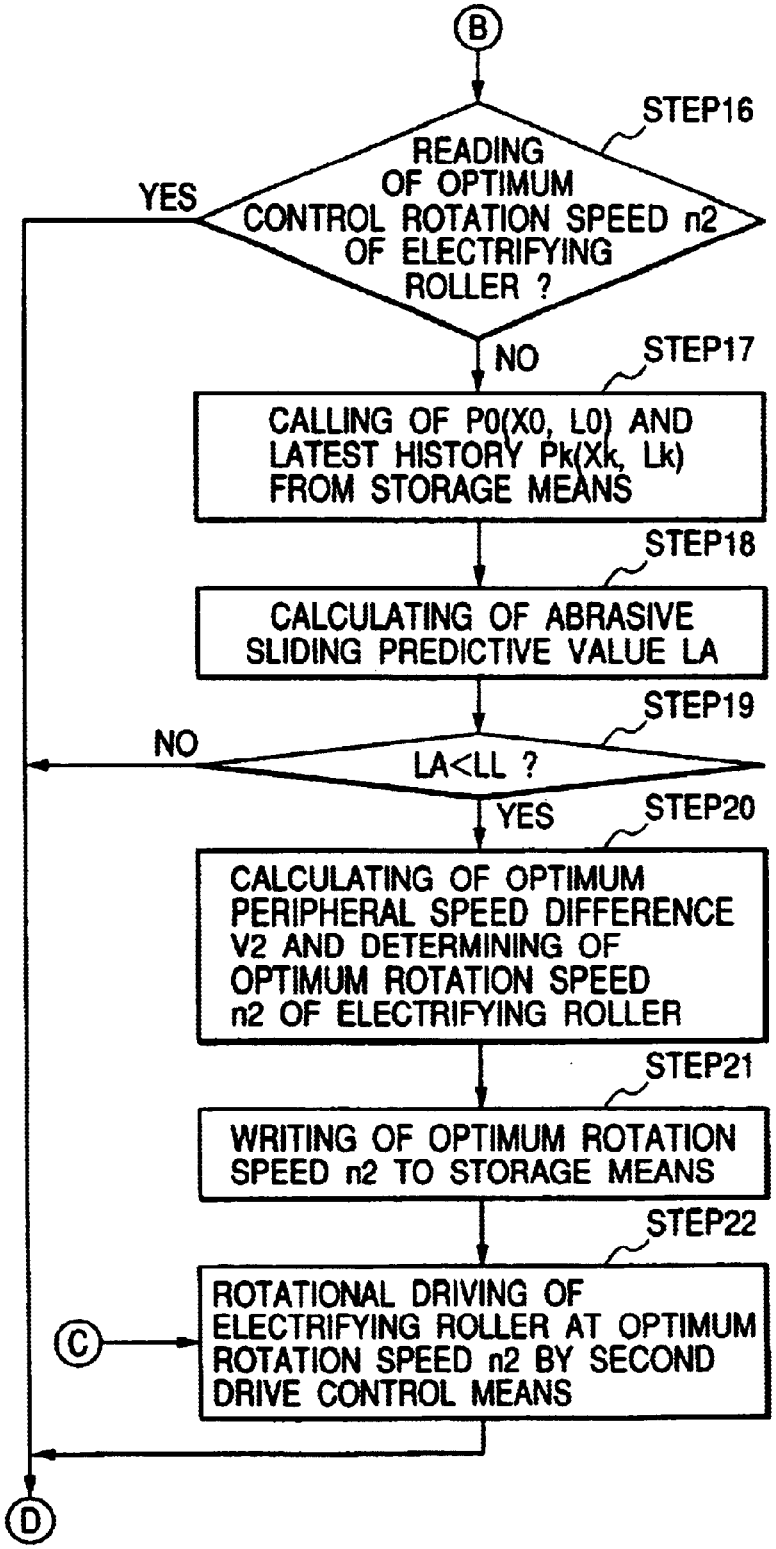
FIG. 18 is a third flowchart for explanation of a control method in accordance with the fourth embodiment.

FIG. 15 is a graph showing a relationship of the amount of toner, the abrasive sliding distance and the peripheral speed difference under the control according to this embodiment. FIGS. 16 to 18 are flowcharts for explanation of the control method in accordance with this embodiment.

First, the graph showing the consumed amount of toner, the abrasive sliding distance and the peripheral speed difference shown in FIG. 15 will be described. This shows a relationship of the consumed amount of toner, and the abrasive sliding distance of the photosensitive member drum 7 and the electrifying roller 8 in use of the process cartridge. The lateral axis is the consumed amount of toner, and the vertical axis is the abrasive sliding distance.

a) Toner Consumption Amount X

A toner consumption amount X is obtained by calculating a difference between the initial amount of toner and the present amount of toner by the calculation control means 651 on the basis of the information obtained by the toner amount detection means 20. The toner consumption amount X is stored during the storage means 60 of the process cartridge B.

The toner consumption amount limit XX is the amount of a limit where the toner can be consumed. The value of the toner consumption amount limit XX is stored in the storage means 60 of the process cartridge B in advance.

b) Abrasive Sliding Distance L

An abrasive sliding distance L on the contact portion of the photosensitive member drum 7 and the electrifying roller 8 is obtained by calculating a product (L=V×T) of the peripheral speed difference V and the rotation drive time T of the photosensitive member drum 7 and the electrifying roller 8 by the calculation control means as described above.

The abrasive sliding limit LL is directed to a limit value where abrasive sliding is enabled. The abrasive sliding limit LL is stored in the storage means 60 of the process cartridge B in advance.

c) Read/write of the Toner Consumption Amount X and the Abrasive Sliding Distance L The toner consumption amount X and the abrasive sliding distance L are written/read in/from the storage means 60 of the process cartridge B through the read/write means 611 at a predetermined timing.

In this embodiment, as a write timing, a timing (X1, X2, . . . ) at which a predetermined amount of toner has been consumed is applied. At this timing, data related to the toner consumption amount X and the abrasive sliding distance L is stored in the storage means 60 as a set. As other examples of the writing timing, a timing at which a predetermined amount of recording medium 2 is printed, or a timing at which a predetermined abrasive sliding distance L is consumed may be applied.

d) Abrasive Sliding Predictive Value LA

Points (P0, P1, P2, . . . pj−2, Pj−1, Pj) plotted in FIG. 11 are data set of the toner consumption amount X and the abrasive sliding distance L which are stored in the process cartridge B. The data set represents the history from the start of using the process cartridge B (P0) until the present time (Pj). By using this data, the abrasive sliding distance at the toner consumption amount limit XX is predicted.

The predicted line 1 that represents the relationship of the toner consumption amount X and the abrasive sliding distance L is obtained by using two points of P0 and Pj, and the abrasive sliding predictive value LA at the toner consumption amount limit XX is also obtained.

In this embodiment, in order to obtain the predicted line, two points of P0 and Pj are used, but a method of conducting primary approximation using P0, P1, . . . , Pj−1, Pj may be applied.

e) Electrifying Roller Rotation Speed Control

The abrasive sliding predictive value LA and the abrasive sliding limit LL are compared with each other. In the case where the abrasive sliding predictive value LA is smaller than the abrasive sliding limit LL, since it means that there is obtained a margin in the lifetime of the photosensitive member drum 7 unit, the rotation speed of the electrifying roller 8 increases (the peripheral speed difference increases), and the margin of the photosensitive member drum 7 is effectively used in maintaining the electrifying performance.

In more detail, assuming that the peripheral speed difference V between P0 and Pj is V1 and the peripheral speed difference subsequent to Pj is V2, V2 is controlled such that Pj and the subsequent points are put on the control line shown in FIG. 15 (V1<V2).

The control line is directed to a line that connects two points of Pj(Xj,Lj) and the abrasive sliding limit PP(XX, LL), and if the toner consumption X and the abrasive sliding distance L undergo transitions in a relation that satisfies the above line, the toner and the photosensitive member drum 7 can end their lifetimes at the same time.

Since the inclinations of the predicted line and the control line and the peripheral speed difference V satisfy a proportional relation, the following expression is obtained:

$$V1:V2=Lj/Xj:(LL-Lj)/(XX-Xj)$$

From the above expression, $$\text{Peripheral speed difference } V2=((LL-Lj)/(XX-Xj))/(Lj/Xj)\times V1$$

In addition, since the peripheral speed difference V2 is the sum of the peripheral speed Va of the photosensitive member drum 7 surface and the peripheral speed Vb of the electrifying roller 8 surface, V2=Va+V2b (V2b is a peripheral speed of the electrifying roller 8 after being controlled, and Va is fixed because it is not controlled)

$$V2b \text{ is calculated from } V2b=V2-Va.$$

The rotation speed n2 of the electrifying roller 8 is obtained by dividing the peripheral speed V2b by the radius of the electrifying roller. Thereafter, the electrifying roller 8 is rotationally driven at the rotational speed n2 thus obtained.

The above-mentioned control method will be described with reference to flowcharts shown in FIGS. 16 to 18.

Step 1: The printer main body 14 turns on, or a CRG is inserted, and upon detection of this, control is advanced to Step 2.

Step 2: it is judged whether the inserted process cartridge B is a new one, or not in Step 2. Information on whether the process cartridge B is new or not is judged depending on whether the toner consumption history and the abrasive sliding history have been written in the storage means 60 disposed in the process cartridge. If those histories have not been written in, it is judged that the inserted process cartridge B is new, and control is advanced to Step 3. On the other hand, if those histories have been written in, since the inserted process cartridge B is not new, control is advanced to Step 4.

Step 3: In the case where the inserted process cartridge B is new, the initial value P0 (X0, L0)=(0,0) of the toner consumption history and the abrasive sliding history, and the final information P(X,L)=(0,0) are written in the storage means 60. After the initial value P0 and the final information P(X,L) are written in the storage means 60, control is advanced to a step 4.

Step 4: The latest toner consumption history information Xk is read from the storage means 60.

Step 5: The final toner consumption information X and the abrasive sliding information L are read from the storage means 60.

Step 6: In order to discriminate whether the optimum control of the electrifying roller 8 has been already conducted, or not, the optimum rotation speed n2 is read. If the optimum rotation speed n2 is normally read, since the optimum control is conducted, control is advanced to Step 22 whereas if the data is not read, since the electrifying roller 8 is in a non-control state, control is advanced to Step 7.

Steps 7, 8 and 9: The abrasive sliding distance L is integrated from the peripheral speed difference of the photosensitive member drum 7 and the electrifying roller 8 and the rotation period of time during the rotation of the photosensitive member drum 7 and the electrifying roller 8. The abrasive sliding distance L is a total abrasive sliding distance from the start of using the cartridge. After the rotation stops, control is advanced to Step 10.

Step 10: The remaining toner amount is measured and the toner consumption amount X at the present time is calculated by using the toner amount detection means 20.

Step 11: After the rotation stops, the final information on the toner consumption amount X and the abrasive sliding distance L, which is stored in the storage means 20, is overwritten and updated.

Step 12: Since there is applied a system in which the information on the toner consumption amount and the abrasive sliding distance is added in the storage means as the history and written every time a predetermined amount of toner XC is consumed, an increase (X−Xk) in the toner consumption from the toner consumption amount Xk of the latest history that has been previously stored is calculated.

If the predetermined amount of toner XC has been consumed, control is advanced to Step 13 in order to add the history, whereas if the predetermined amount of toner XC has not been consumed, control is advanced to Step 7.

Step 13: Since the number of histories increases, a subscript k is incremented.

Step 14: the final information P(X,L) is added to the storage means 20 as the latest history Pk(Xk,Lk) and written in.

Step 15: Since the deterioration of the electrifying performance occurs in the later stage of the lifetime of the CRG, it is desirable that the rotation control of the electrifying roller 8 is conducted in the relatively later stage. Even if the rotation speed unnecessarily increases from the initial stage, the drum lifetime is reduced without any advantages. Therefore, according to the present invention, the toner consumption amount XT of the CRG lifetime later stage (about 60 to 80% of the CRG lifetime) is set as a trigger for starting the rotation speed control of the electrifying roller 8. When the toner consumption amount X exceeds the toner consumption amount XT that functions as the trigger, control is advanced to Step 17 and its subsequent steps in order to conduct the rotation speed control. On the other hand, if the toner consumption amount X does not exceed the toner consumption amount XT, it is determined that the rotation speed control is unnecessary, and control is advanced to Step 7. The toner consumption amount XT that functions as the trigger corresponds to Xj in FIG. 15.

Step 16: In order to discriminate whether the optimum control of the electrifying roller 8 has been already conducted, or not, the optimum rotation speed n2 is read.

If the optimum rotation speed n2 is normally read, since the optimum control is conducted, control is advanced to Step 7. In order that the abrasive sliding distance L and the toner consumption amount X are integrated until all toner is consumed and then recorded in the storage means 60, control is advanced to Step 7. If the optimum rotation speed data is not read, in order that the rotation drive control at the optimum rotation speed n2 is conducted, control is advanced to Step 17.

Step 17: In order to obtain the control line, the initial value P0 (X0, L0) and the latest history Pk(Xk,Lk) are accessed, which correspond to Pj(Xj,Lj) in FIG. 11.

Step 18: The abrasive sliding predictive value LA is calculated by the calculation control means 651.

Step 19: The abrasive sliding limit LL and the abrasive sliding predictive value LA are compared with each other. If the abrasive sliding predictive value LA is smaller than the abrasive sliding limit LL, since it can be presumed that there is obtained a margin in the drum lifetime, control is advanced to a step 20 in which the rotation speed control of the electrifying roller 8 is conducted. If the abrasive sliding predictive value LA is not smaller than the abrasive sliding limit LL, control is advanced to the step 7.

Step 20: The optimum rotation speed of the electrifying roller 8 is calculated. For that reason, the optimum peripheral speed difference V2 is first calculated. The optimum rotation speed n2 of the electrifying roller 8 is determined in accordance with the optimum peripheral speed difference V2.

Step 21: The optimum rotation speed n2 is written in the storage means 60.

Step 22: A mode in which the electrifying roller 8 is driven at the optimum rotation speed n2 is applied by the second drive control means. In order that until all toner is consumed, the abrasive sliding distance L and the toner consumption amount X are sequentially integrated and recorded in the storage means 60, control is advanced to the step 7.

As described above, the margin of the photosensitive member drum 7 is calculated by using the histories of the toner consumption amount X and the abrasive sliding distance L of the photosensitive member drum 7 and the electrifying roller 8, and the optimum control of the electrifying roller 8 is conducted in accordance with the margin thus obtained so as to increase the rotation speed, thereby providing the capability of maintaining the electrifying property over long-period usage.

(Fifth Embodiment)

Figure 19:
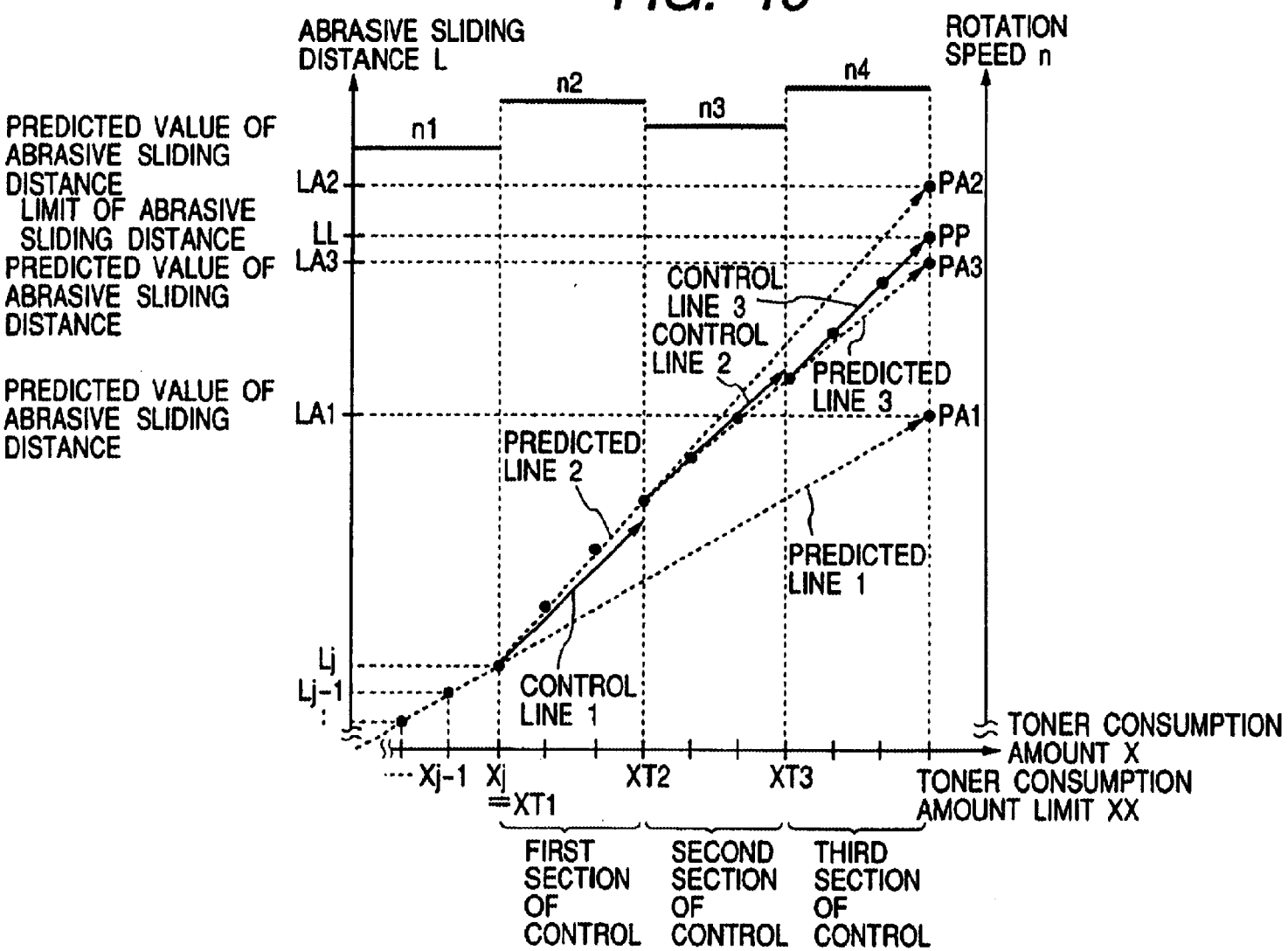
FIG. 19 is a diagram for explanation of a electrifying roller rotation speed changing method in accordance with a fifth embodiment.

FIG. 19 is a graph showing the relationship of the toner consumption amount and the abrasive sliding distance for explanation of a fifth embodiment. In this embodiment, a further finer control method is applied.

The control line according to the fourth embodiment is made provided a past state continues in the future, and therefore a difference may occur between the actual state and the past state. This is because the relationship between the toner consumption and the abrasive sliding distance changes due to a variation of the printing ratio or the number of sheets to be printed.

In the fourth embodiment, only one trigger is provided for optimal driving of the electrifying roller 8 under the control, but in this embodiment, a plurality of triggers are provided to conduct finer control.

In this embodiment, since what is different from the fourth embodiment resides in the control subsequent to the control trigger XT1 of the electrifying roller 8, the different part of the control will be described.

1) The Rotation Speed Control of the Electrifying Roller 8: First Section

After the toner consumption amount reaches XT1, the predicted line 1 and the abrasive sliding predicted value LA1 are obtained in accordance with the histories of the toner consumption amount X and the abrasive sliding distance L from the toner consumption amount initial stage until the trigger XT1, and the control line 1 is obtained in accordance with the above histories and the abrasive sliding limit PP (XX,LL).

The optimum rotation speed n2 of the electrifying roller 8 is obtained in accordance with the predicted line 1 and the control line 1. Thereafter, the electrifying roller 8 is rotatably driven at the optimum rotation speed n2.

Since the abrasive sliding predictive line LA1 is smaller than the abrasive sliding limit LL, the rotation speed of the electrifying roller 8 increases (n2>n1).

In FIG. 19, the control line 1 is partially drawn taking the facility of understanding the figure into consideration, but a leading end of the control line 1 is directed to the abrasive sliding limit point PP.

2) The Rotation Speed Control of the Electrifying Roller 8: Second Section

After the toner consumption amount reaches XT2, the predicted line 2 and the abrasive sliding predicted value LA2 are obtained in accordance with the histories of the toner consumption amount X and the abrasive sliding distance L from the trigger XT1 to the trigger XT2, the control line 2 is obtained in accordance with the above histories and the abrasive sliding limit PP (XX,LL).

The optimum rotation speed n3 of the electrifying roller 8 is obtained in accordance with the predicted line 2 and the control line 2. Thereafter, the electrifying roller 8 is rotatably driven at the optimum rotation speed n3.

Since the abrasive sliding predicted line LA2 is larger than the abrasive sliding limit LL, the rotation speed of the electrifying roller 8 decreases (n3<n2).

In FIG. 19, the control line 2 is partially drawn taking the facility of understanding the figure into consideration, but a leading end of the control line 2 is directed to the abrasive sliding limit point PP.

3) The Rotation Speed Control of the Electrifying Roller 8: Third Section

After the toner consumption amount reaches XT3, the predicted line 3 and the abrasive sliding predicted value LA3 are obtained in accordance with the histories of the toner consumption amount X and the abrasive sliding distance L from the trigger XT2 to the trigger XT3, and the control line 3 is obtained in accordance with the above histories and the abrasive sliding limit PP (XX,LL).

The optimum rotation speed n4 of the electrifying roller 8 is obtained in accordance with the predicted line 3 and the control line 3. Thereafter, the electrifying roller 8 is rotatably driven at the optimum rotation speed n4.

Since the abrasive sliding predicted line LA3 is smaller than the abrasive sliding limit LL, the rotation speed of the electrifying roller 8 increases (n4>n3).

In FIG. 15, the control line 3 is partially drawn taking the facility of understanding the figure into consideration, but a leading end of the control line 3 is directed to the abrasive sliding limit point PP.

In the first to third sections, the history data of the toner consumption amount X and the abrasive sliding distance L is recorded in the storage means as in the preceding sections.

As described above, since the rotation speed change of the electrifying roller 8 is conducted at multiple stages, accurate control can be conducted that does not depend on the printing ratio or a variation in the number of sheets that are continuously printed, and a long-period maintenance of the process cartridge electrifying property can be made by effectively using the margin of the photosensitive member drum 7.

In this embodiment, the control section is divided into three sections, but it is unnecessary to divide the control section into three.

Also, three data histories are set as one section, but it is unnecessary to limit one section to three data histories.

In addition, the history data is saved every time a predetermined amount of toner is consumed, but the saving timing may use a parameter such as the abrasive sliding distance or a period of time.

Then, the timing at which the history data is saved is set every time the predetermined amount of toner is consumed, but it is unnecessary to limit the amount of toner to a predetermined amount.

(Sixth Embodiment)

Figure 20:
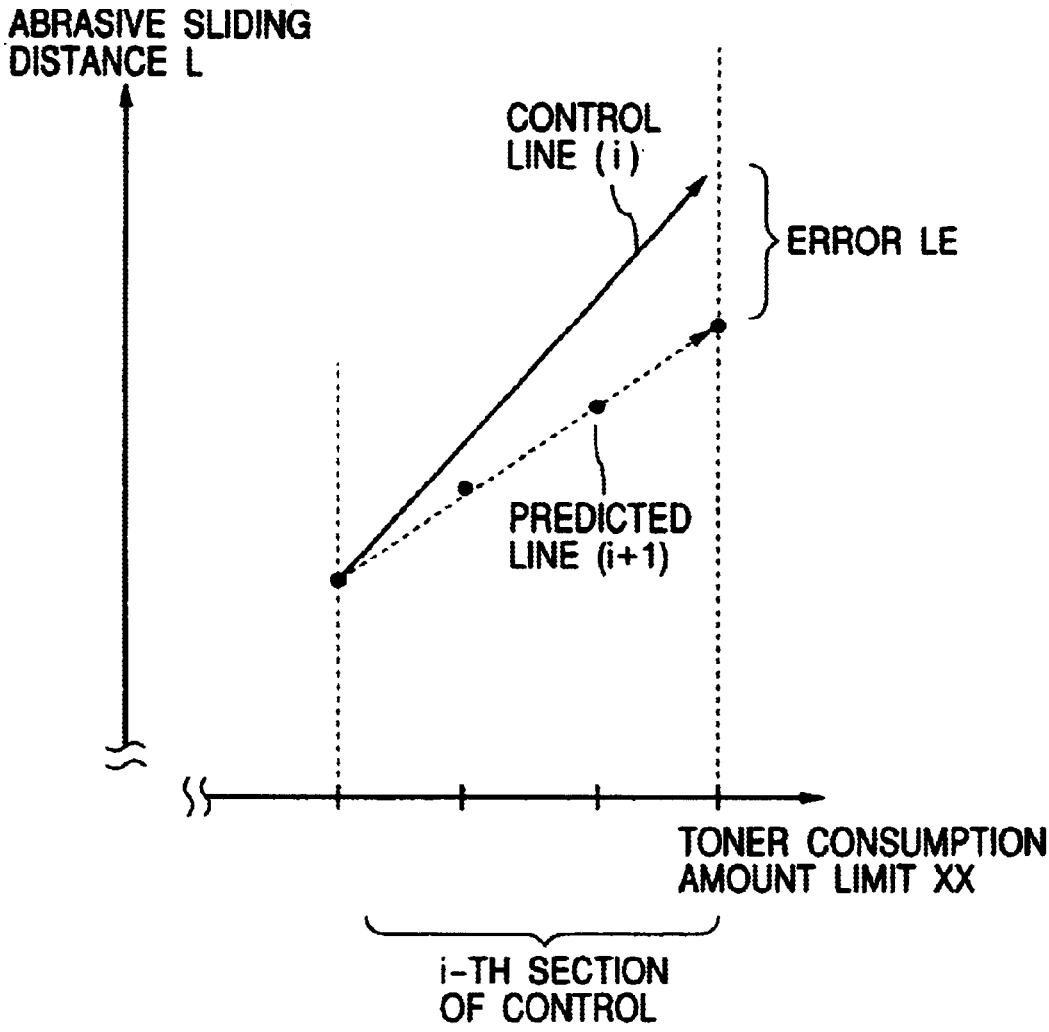
FIG. 20 is a diagram for explanation of a electrifying roller rotation speed changing method in accordance with a sixth embodiment.

A sixth embodiment will be described with reference to FIG. 20. FIG. 20 is a graph for explanation of a control method in accordance with this embodiment. In this embodiment, a still further finer control method will be applied.

An error LE of the abrasive sliding distance L, at the toner consumption limit XX between the control line (i) derived from the prediction and the predicted line (i+1) to which the actual history approximates, becomes larger as the control stage is closer to the initial stage, if the ratio of the difference between the prediction and the actual history is identical. Also, it is not desirable to decrease the rotation speed when the rotation speed is shifted from the optimum rotation speed n2 to the optimum rotation speed n3 as in the second embodiment, but it is desirable to gradually increase the rotation speed of the electrifying roller 8.

Hence, in this embodiment, the abrasive sliding limit LL (abrasive sliding target value) used as the target of the control line is gradually largely changed in accordance with a use process, to thereby gradually increase the rotation speed of the electrifying roller.

Figure 21:
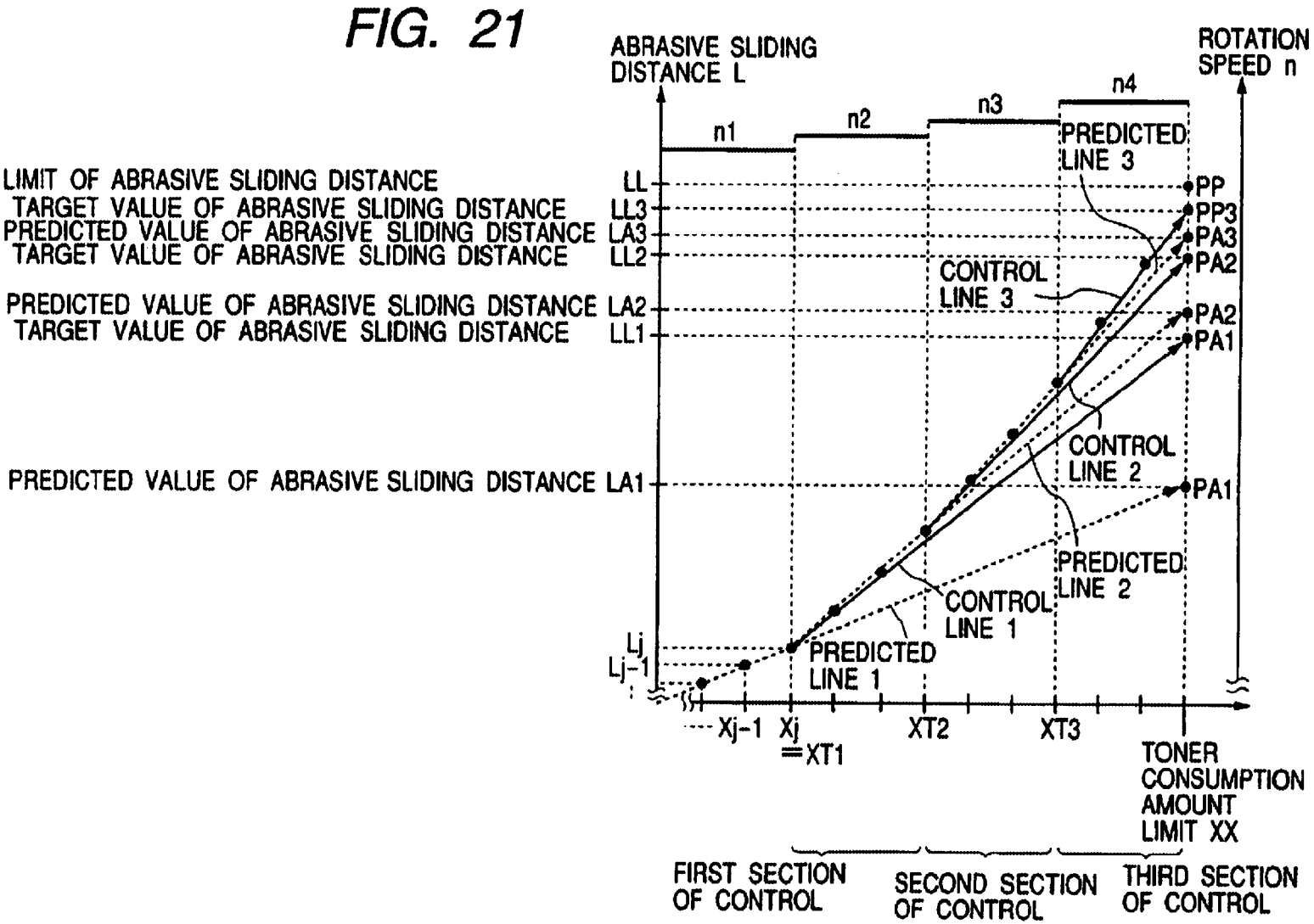
FIG. 21 is a diagram for explanation of a electrifying roller rotation speed changing method in accordance with the sixth embodiment.

More specifically, this method will be described with reference to FIG. 21. FIG. 21 is a graph for explanation of the relationship of the toner amount, the abrasive sliding distance and the peripheral speed difference under the control in accordance with this embodiment.

In this embodiment, what is different from the above-mentioned second embodiment resides in the control subsequent to the control trigger XT1 of the electrifying roller 8, and therefore a different part of the control will be described.

1) The Rotation Speed Control of the Electrifying Roller 8: First Section

After the toner consumption amount reaches XT1, the predicted line 1 and the abrasive sliding predicted value LA1 are obtained in accordance with the histories of the toner consumption amount X and the abrasive sliding distance L from the toner consumption amount initial stage to the trigger XT1, and the control line 1 is obtained in accordance with the above histories and the abrasive sliding target value LL1.

The abrasive sliding target value LL1 is a value that internally divides the abrasive sliding limit LL and the abrasive sliding predictive value LA1 into s:t, which is represented by the following expression:

$$LL1=(t\times LL+s\times LA1)/(s+t)$$

In this embodiment, s:t=1:1

The optimum rotation speed n2 of the electrifying roller 8 is obtained in accordance with the predicted line 1 and the control line 1. Thereafter, the electrifying roller 8 is rotatably driven at the optimum rotation speed n2.

Since the abrasive sliding predicted line LA1 is smaller than the abrasive sliding target value LL1, the rotation speed of the electrifying roller 8 increases (n2>n1).

2) The Rotation Speed Control of the Electrifying Roller 8: Second Section

After the toner consumption amount reaches XT2, the abrasive sliding predicted value LA2 and the predicted line 2 are obtained in accordance with the histories of the toner consumption amount X and the abrasive sliding distance L from the trigger XT1 to the trigger XT2, and the control line 2 is obtained in accordance with the above histories and the abrasive sliding target value LL2.

The abrasive sliding target value LL2 is a value that internally divides the abrasive sliding limit LL and the abrasive sliding predictive value LA2 into s:t, which is represented by the following expression:

$$LL2=(t\times LL+s\times LA2)/(s+t)$$

In this embodiment, s:t=1:1

The optimum rotation speed n3 of the electrifying roller 8 is obtained in accordance with the predicted line 2 and the control line 2. Thereafter, the electrifying roller 8 is rotatably driven at the optimum rotation speed n3.

Since the abrasive sliding predicted line LA2 is smaller than the abrasive sliding target value LL2, the rotation speed of the electrifying roller 8 increases (n3>n2).

3) The Rotation Speed Control of the Electrifying Roller 8: Third Section

After the toner consumption amount reaches XT3, the abrasive sliding predicted value LA3 and the predicted line 3 are obtained in accordance with the histories of the toner consumption amount X and the abrasive sliding distance L from the trigger XT2 to the trigger XT3, and the control line 3 is obtained in accordance with the above histories and the abrasive sliding target value LL3.

The abrasive sliding target value LL3 is a value that internally divides the abrasive sliding limit LL and the abrasive sliding predictive value LA3 into s:t, which is represented by the following expression:

$$LL3=(t\times LL+s\times LA3)/(s+t)$$

In this embodiment, s:t=1:1, but since the third section is a final section, s:t=0:1 may be set.

The optimum rotation speed n4 of the electrifying roller 8 is obtained in accordance with the predicted line 3 and the control line 3. Thereafter, the electrifying roller 8 is rotatably driven at the optimum rotation speed n4.

Since the abrasive sliding predicted line LA3 is smaller than the abrasive sliding target value LL3, the rotation speed of the electrifying roller 8 increases (n4>n3).

In the first to third sections, the history data of the toner consumption amount X and the abrasive sliding distance L is recorded in the storage means as in the preceding sections.

As described above, the abrasive sliding target value LAi is made to gradually approach the abrasive sliding limit value LL so that the rotation speed of the electrifying roller 8 can be gradually increased, and a long-period maintenance of the process cartridge electrifying property can be made by effectively using the margin of the photosensitive member drum 7.

In this embodiment, the control section is divided into three sections, but it is unnecessary to divide the control section into three.

Also, three data histories are set as one section, but it is unnecessary to limit one section to three data histories.

In addition, the history data is saved every time a predetermined amount of toner is consumed, but the saving timing may use a parameter such as the abrasive sliding distance or a period of time.

Then, the timing at which the history data is saved is set every time the predetermined amount of toner is consumed, but it is unnecessary to limit the amount of toner to a predetermined amount.

(Seventh Embodiment)

In a sixth embodiment, a case in which the printer main body 14 has a plurality of image formation process speeds will be described.

a) Correlation of a process speed and an electrifying property

There is exemplified a printer main body that enables plural-mode printing with a mode of a speed p times as high as a basic speed.

It is assumed that the peripheral speed of the photosensitive member drum 7 in a non-control state at the basic speed is Va, and the peripheral speed of the electrifying roller 8 is Vb. At the p-times process speed, in order to maintain the same electrifying property as the basic speed, it is necessary to make the peripheral speed ratio of the photosensitive member drum 7 and the electrifying roller 8 identical.

$$Va/Vb=\text{const.}$$

b) A description will be given of a relationship of the peripheral speeds of the photosensitive member drum 7 and the electrifying roller 8 in the plural-mode printing by using a relative table 1 of the peripheral speed of the photosensitive member drum 7 and the peripheral speed of the electrifying roller 8 in the plural-mode printing.

TABLE 1

| | Relationship of drum peripheral speed and electrifying roller peripheral speed | |
|---|---|---|
| | Under non-control | Under control |
| Basic mode | | |
| Drum peripheral speed | Va | Va |
| Electrifying roller peripheral speed | Vb | V2b |
| Other modes | | |
| Drum peripheral speed | Va_p (= Va × p) | Va_p |
| Electrifying roller peripheral speed | Vb_p (= Vb × p) | V2b_p (= V2b × p) |

(1) Basic Mode

It is assumed that the drum peripheral speed is Va and the electrifying roller peripheral speed is Vb during the non-control of the basic mode. The electrifying roller peripheral speed V2b under the control is obtained in accordance with the relationship of the abrasive sliding limit LL (abrasive sliding target value) and the abrasive sliding predictive value LA as described in the above-mentioned embodiment. The photosensitive member drum peripheral speed under the control is identical with the speed (Va) under the non-control.

(2) Other Modes

Then, the peripheral speeds of the photosensitive member drum 7 and the electrifying roller 8 at other modes will be described.

It is assumed that the process speed in this situation is p times higher than that of the basic mode. Therefore, the drum peripheral speed is Va_p=Va×p. Also, even in the electrifying roller control, the photosensitive member drum peripheral speed is Va_p, which is fixed.

Also, assuming that the electrifying roller peripheral speed is Vb_p, because the electrifying roller peripheral speed under the non-control maintains the same electrifying performance as that in the basic mode, the electrifying roller peripheral speed is represented by the following expression:

$$Vb_p=Vb\times p$$

As a result, the ratio of the peripheral speed in the p-times process speed (under the non-control), that is, Va_p/Vb_p is identical with Va/Vb of the basic speed.

The electrifying roller peripheral speed under the control maintains the same electrifying performance as does in the basic mode similar to the case under the non-control, and therefore, the peripheral speed ratio in the basic mode and the peripheral speed ratio in other modes are made identical with each other.

Assuming that the electrifying roller peripheral velocity under the control is V2b_p, Va/V2b=Va_p/V2b_p must be satisfied, because of Va_p=Va×p, V2b_p=V2b×p Therefore, the drive control of the electrifying roller 8 except for the basic mode first calculates the electrifying roller peripheral speed V2b in the basic mode, and p is then obtained in accordance with the process speeds in both of those modes, and the electrifying roller 8 is driven at a peripheral speed (V2b×p) resulting from multiplying V2b by p under the control.

In the case where the printer has a plurality of process speeds, it is necessary to conduct the control not by using the abrasive sliding time of the contact electrifying member but by using the abrasive sliding distance.

(Eighth Embodiment)

In the first to seventh embodiments, it is assumed that algorithm that controls the electrifying roller 8 is saved in a ROM (not shown) installed in the printer main body 14, but it is possible that the algorithm is recorded in the storage means 60 of the process cartridge B which is a consumption part, and the printer main body 14 reads the algorithm from the storage means 60 if necessary, and conducts the rotation speed control of the electrifying roller 8 in compliance with the algorithm. This is because after the use of the process cartridge B, the cartridge is collected, the histories of the toner consumption amount X and the abrasive sliding distance L recorded in the storage means 60 is read, and the data is analyzed, thereby providing the capability for the user to grasp the use state in more detail. If the rotation control algorithm of the electrifying roller 8 is stored in the process cartridge B, an improved algorithm can be readily sequentially supplied to the user, and customization can be made to specify a desired user.

(Ninth Embodiment)

In the first to sixth embodiments, the rotation speed n of the electrifying roller 8 is derived from the control line and the predicted line. However, it is desirable to set the lower limit of the rotation speed from the viewpoint of the performance of the electrifying property and the upper limit of the rotation speed from the viewpoint of an influence on the image. Therefore, there is provided a step of checking whether the calculated result is within the upper and lower limits of the rotation speed after the optimum rotation speed n of the electrifying roller 8 is calculated. If the calculated result is the lower limit or lower, the rotation speed of the electrifying roller 8 is corrected to the lower limit value, and if the calculated result is the upper limit or higher, the rotation speed of the electrifying roller 8 is corrected to the upper limit value, and the electrifying roller 8 is driven at the corrected rotation speed under the control.

The above-mentioned process cartridge B is so adapted as to form a monochromatic image, but the process cartridge can be appropriately applied to a case of forming the monochromic image, and also to an image forming apparatus in which a plurality of process cartridges are disposed to form a multi-color image (for example, a two-color image, a three-color image, a full-color image or the like).

Also, the electrophotographic photosensitive member that functions as the image bearing member is not limited to the photosensitive member drum, but includes the following elements. First, the photosensitive member is formed of a photoconductive member, and the photoconductive member may be made of, for example, amorphous silicon, amorphous resin, tin oxide, titanium oxide, organic photoconductor (OPC) or the like.

In general, the electrophotoconductive member is formed in a drum and produced by depositing or coating a photoconductive material on a cylinder made of aluminum alloy or the like.

The image bearing member may be formed of an electrostatic recording dielectric member that is subjected to the electrostatic recording process.

The contact electrifying means is not limited to the injection electrifying system using the charge accelerating particles as in the above embodiment.

The toner frame 11 and the developing frame 12 may be made of plastic such as polyethylene, an ABS resin (acrylonitrile/butadiene/styrene copolymer), a regenerated PPE resin (polyphenylene ether), a regenerated PPO resin (polyphenylene oxide), polycarbonate, polyethylene, polypropylene or the like.

Also, the above-mentioned process cartridge includes, for example, an electrophotosensitive member and at least an electrifying means. Therefore, as a mode of the process cartridge, for example, the electrophotographic member, the developing means and the electrifying means are integrated together into a cartridge and detachably attachable to the apparatus main body, and the electrophotographic member and the electrifying member are integrated together into a cartridge and detachably attachable to the apparatus main body other than the above-mentioned embodiments.

That is, the above-mentioned process cartridge is designed in such a manner that the developing means, the electrifying means and the electrophotographic photosensitive member are integrated together into a cartridge, and the cartridge is detachably attachable to the image forming apparatus main body. Also, the electrifying means and the electrophotographic photosensitive member are integrated together into a cartridge, and the cartridge is detachably attachable to the image forming apparatus main body.

In addition, in the above-mentioned embodiment, the image forming apparatus is exemplified by a laser beam printer, but the present invention is not limited to such a printer. It goes without saying that the present invention is applicable to other image forming apparatuses such as an electrophotographic copying machine, a facsimile machine or a word processor.

Summarizing the image forming apparatus according to the above-mentioned first to ninth embodiments, the electrifying performance can be appropriately maintained for a long-period usage.

The rotation speed of the electrifying roller 8 increases up to a speed written in the storage means 60 in accordance with toner consumption, thereby providing the capability of maintaining the electrifying property over a long period.

The optimum control of the electrifying roller 8 is conducted by using the toner consumption amount L and the abrasive sliding distance L of the photosensitive member drum 7 and the electrifying roller 8 to increase the rotation speed, thereby providing the capability of maintaining the electrifying property over a long-period usage by effectively using the drum lifetime margin.

Since the rotation speed change of the electrifying roller 8 is conducted at multiple stages, accurate control can be conducted that does not depend on the printing ratio or a variation in the number of sheets that are continuously printed, and a long-period maintenance of the process cartridge electrifying property can be made.

The abrasive sliding target value LAi is made to gradually approach the abrasive sliding limit value LL so that the rotation speed of the electrifying roller 8 can be gradually increased, and a long-period maintenance of the process cartridge electrifying property can be made.

Since the lifetime of the photosensitive member drum is managed not by the abrasive sliding time, but by the abrasive sliding distance, even in the case where a plurality of image forming process speeds is provided, lifetime management can be accurately conducted (in the case of managing the lifetime by the time, the accurate lifetime management cannot be conducted under the condition of the plural image forming process speeds).

Since the histories of the toner consumption amount X and the abrasive sliding distance L are recorded in the storage means 60 of the process cartridge B, even if the process cartridge is used in another printer main body, the long-period maintenance of the electrifying property can be conducted under the optimum electrifying roller control.

Since the histories of the toner consumption amount X and the abrasive sliding distance L are recorded in the storage means 60 of the process cartridge B, after the use of the process cartridge B, the process cartridge B is collected and the histories of the toner consumption amount X and the abrasive sliding distance L recorded in the storage means 60 are read, and the data is analyzed, thereby providing the capability for the user to grasp the use state in more detail.

Also, in the case where the specification changes in the process cartridge B, if the data stored in the storage means changes, the optimum rotation speed of the electrifying roller 8 can be maintained without changing the image forming apparatus main body.

Also, even if the rotation speed of the contact electrifying member is not within a predetermined range, because the rotation speed control can be conducted within a predetermined range, the performance of the electrifying property can be maintained.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus to which a process cartridge having an image bearing member, a contact electrifying member for the image bearing member, detection means for detecting a developer remaining amount or a developer consumption amount, and storage means, is detachably attachable, said image forming apparatus comprising:

first drive means for rotationally driving the image bearing member;

second drive means for rotationally driving the contact electrifying member; and control means for controlling the driving speeds of said first drive means and said second drive means;

wherein said control means controls the driving speed of said second drive means on the basis of data representing a rotation speed of said second drive means stored in the storage means.

2. An image forming apparatus according to claim 1, wherein said control means changes the driving speed of said second drive means on the basis of the data representing a rotation speed stored in the storage means when the developer remaining amount or developer consumption amount detected by the detection means reaches a predetermined value.

3. An image forming apparatus according to claim 1, wherein said control means controls the rotation speed of said second drive means so as to gradually increase the rotation speed as the developer consumption amount increases or as the developer remaining amount decreases.

4. An image forming apparatus according to claim 1, further comprising developing means for developing a latent image formed on the image bearing member with a developer.

5. An image forming apparatus according to claim 4, wherein the developer of said developing means includes toner and charge accelerating particles having electroconductivity, wherein the contact electrifying member is a plastic electrifying member that forms a nip portion with the image bearing member, and a voltage is applied between the image bearing member and the contact electrifying member through said charge accelerating particles.

6. An image forming apparatus according to claim 1, wherein the image bearing member is a photosensitive member, and the contact electrifying member is an electrifying roller.

7. An image forming apparatus according to claim 1, wherein a program for controlling the driving speed of said second drive means is stored in the storage means.

8. An image forming apparatus according to claim 1, wherein said control means rotationally controls said first drive means at a plurality of driving speeds; and in the case where the driving speed of said first drive means is changed, said control means controls the driving speed of said second drive means so that the ratio of the driving speed of said first drive means and the driving speed of said second drive means before the change in the driving speed of said first drive means becomes identical to the ratio of the driving speed of said first drive means and the driving speed of said second drive means after the change in the driving speed of said first drive means.

9. An image forming apparatus to which a process cartridge having an image bearing member, a contact electrifying member configured and positioned to charge the image bearing member, detection means for detecting a developer remaining amount or developer consumption amount, and storage means, is detachably attachable, said image forming apparatus comprising:

first drive means for rotationally driving the image bearing member;

second drive means for rotationally driving the contact electrifying member; and control means for controlling the driving speeds of said first drive means and said second drive means and calculating the accumulated abrasive sliding distance of the image bearing member and the contact electrifying member, wherein the storage means stores data representing one or more rotation speeds of said second drive means corresponding to the accumulated abrasive sliding distance; and said control means controls the driving speed of said second drive means on the basis of data representing a rotation speed stored in the storage means.

10. An image forming apparatus according to claim 9, wherein said control means changes the driving speed of said second drive means on the basis of the data representing a rotation speed stored in the storage means when the developer remaining amount or developer consumption amount detected by said detection means reaches each of one or more predetermined values.

11. An image forming apparatus according to claim 9, wherein said control means controls the rotation speed of said second drive means so as to gradually increase the rotation speed as the developer consumption amount increases or as the developer remaining amount decreases.

12. An image forming apparatus according to claim 9, further comprising developing means for developing a latent image formed on the image bearing member with a developer.

13. An image forming apparatus according to claim 12, wherein the developer of said developing means includes toner and charge accelerating particles having electroconductivity, wherein the contact electrifying member is a plastic electrifying member that forms a nip portion with the image bearing member, and a voltage is applied between the image bearing member and the contact electrifying member through said charge accelerating particles.

14. An image forming apparatus according to claim 9, wherein the image bearing member is a photosensitive member, and the contact electrifying member is an electrifying roller.

15. An image forming apparatus according to claim 9, wherein a program for controlling the driving speed of said second drive means is stored in the storage means.

16. An image forming apparatus to which a process cartridge having an image bearing member, a contact electrifying member configured and positioned to charge the image bearing member, detection means for detecting a developer remaining amount or developer consumption amount, and storage means, is detachably attachable, said image forming apparatus comprising:

first drive means for rotationally driving the image bearing member;

second drive means for rotationally driving the contact electrifying member; and control means for controlling the driving speeds of said first drive means and said second drive means, calculating the accumulated abrasive sliding distance of the image bearing member and the contact electrifying member, and writing data representing two or more of the calculated accumulated abrasive sliding distances and data representing the developer remaining amount or the developer consumption amount detected by the detection means in the storage means;

wherein said control means calculates a rotation speed of said second drive means on the basis of data representing two or more of the accumulated abrasive sliding distances and the developer remaining amount or developer consumption amount stored in the storage means to control said second drive means on the basis of the calculated rotation speed.

17. An image forming apparatus according to claim 16, wherein data representing the rotation speed calculated by said control means is written in the storage means.

18. An image forming apparatus according to claim 16, wherein said control means changes the driving speed of said second drive means on the basis of the data representing the rotation speed stored in the storage means when the developer remaining amount or developer consumption amount detected by the detection means reaches each of one or more predetermined values.

19. An image forming apparatus according to claim 16, wherein said control means controls the rotation speed of said second drive means so as to gradually increase the rotation speed as the developer consumption amount increases or as the developer remaining amount decreases.

20. An image forming apparatus according to claim 16, further comprising developing means for developing a latent image formed on the image bearing member with a developer.

21. An image forming apparatus according to claim 20, wherein the developer of said developing means includes toner and charge accelerating particles having electroconductivity, the contact electrifying member is a plastic electrifying member that forms a nip portion with the image bearing member, and a voltage is applied between the image bearing member and the contact electrifying member through said charge accelerating particles.

22. An image forming apparatus according to claim 16, wherein the image bearing member is a photosensitive member, and the contact electrifying member is an electrifying roller.

23. An image forming apparatus according to claim 16, wherein a program for controlling the driving speed of said second drive means is stored in the storage means.

24. An image forming apparatus according to claim 16, wherein when the rotation speed calculated by said control means is smaller than a minimum value, the rotation speed is replaced with the minimum value, and when the rotation speed is larger than a maximum value, the rotation speed is replaced with the maximum value.

25. A process cartridge that is detachably attachable to an image forming apparatus including first drive means for rotationally driving an image bearing member, second drive means for rotationally driving a contact electrifying member, and control means for controlling driving speeds of the first drive means and the second drive means, said cartridge comprising:

said image bearing member, said contact electrifying member configured and positioned to charge said image bearing member, detection means for detecting a developer remaining amount or a developer consumption amount, and storage means for storing data representing a rotation speed for changing the driving speed of the second drive means.

26. A process cartridge according to claim 25, wherein when the developer remaining amount or developer consumption amount detected by said detection means reaches a predetermined value, data representing the rotation speed is read from said storage means in order to change the driving speed of the second drive means.

27. A process cartridge according to claim 25, further comprising developing means for developing a latent image formed on said image bearing member with a developer.

28. A process cartridge according to claim 27, wherein the developer of said developing means includes toner and charge accelerating particles having electroconductivity, said contact electrifying member is a plastic electrifying member that forms a nip portion with said image bearing member, and a voltage is applied between said image bearing member and said contact electrifying member through said charge accelerating particles.

29. A process cartridge according to claim 25, wherein said image bearing member is a photosensitive member, and said contact electrifying member is an electrifying roller.

30. A process cartridge according to claim 25, wherein said storage means is a rewritable nonvolatile storage medium.

31. A process cartridge that is detachably attachable to an image forming apparatus including first drive means for rotationally driving an image bearing member, second drive means for rotationally driving a contact electrifying member, and control means for controlling the driving speeds of the first drive means and the second drive means and calculating the accumulated abrasive sliding distance of said image bearing member and said contact electrifying member, said cartridge comprising:

said image bearing member;

said contact electrifying member configured and positioned to charge said image bearing member;

detection means for detecting a developer remaining amount or a developer consumption amount; and storage means for storing at least data representing one rotation speed corresponding to the accumulated abrasive sliding distance for controlling the driving speed of the second drive means.

32. A process cartridge according to claim 31, wherein when the developer remaining amount or developer consumption amount detected by said detection means reaches at least one predetermined value, data representing the rotation speed is read from said storage means in order to change the driving speed of the second drive means.

33. A process cartridge according to claim 31, further comprising developing means for developing a latent image formed on said image bearing member with a developer.

34. A process cartridge according to claim 33, wherein the developer of said developing means includes toner and charge accelerating particles having electroconductivity, said contact electrifying member is a plastic electrifying member that forms a nip portion with said image bearing member, and a voltage is applied between said image bearing member and said contact electrifying member through said charge accelerating particles.

35. A process cartridge according to claim 31, wherein said image bearing member is a photosensitive member, and said contact electrifying member is an electrifying roller.

36. A process cartridge according to claim 31, wherein said image bearing member is a photosensitive member, and said contact electrifying member is an electrifying roller.

37. A process cartridge that is detachably attachable to an image forming apparatus including first drive means for rotationally driving an image bearing member, second drive means for rotationally driving a contact electrifying member, and control means for controlling driving speeds of the first drive means and the second drive means and calculating the accumulated abrasive sliding distance of said image bearing member and said contact electrifying member, said cartridge comprising:

said image bearing member;

said contact electrifying member configured and positioned to charge said image bearing member;

detection means for detecting a developer remaining amount or a developer consumption amount; and storage means for storing data representing two or more of the accumulated abrasive sliding distances, and the developer remaining amount or developer consumption amount therein.

38. A process cartridge according to claim 37, wherein data representing a rotation speed of the second drive means for changing the driving speed of the second drive means is written in said storage means when the developer remaining amount or the developer consumption amount detected by said detection means reaches each of one or more predetermined values.

39. A process cartridge according to claim 37, further comprising developing means for developing a latent image formed on said image bearing member with a developer.

40. A process cartridge according to claim 39, wherein the developer of said developing means includes toner and charge accelerating particles having electroconductivity, said contact electrifying member is a plastic electrifying member that forms a nip portion with said image bearing member, and a voltage is applied between said image bearing member and said contact electrifying member through said charge accelerating particles.

41. An image forming apparatus comprising:

an image bearing member;

a contact electrifying member configured and positioned to charge said image bearing member;

storage means for storing data according to a developer remaining amount; and control means for variably controlling peripheral speeds of said image bearing member and said contact electrifying means in accordance with the data stored in said storage means.

42. An image forming apparatus comprising:

an image bearing member;

a contact electrifying member configured and positioned to charge said image bearing member;

storage means for storing data according to a used developer amount; and control means for calculating an accumulated abrasive sliding distance of said image bearing member and said contact electrifying member to variably control peripheral speeds of said image bearing member and said contact electrifying member in accordance with the calculated accumulated abrasive sliding distance and the data stored in said storage means.

* * * * *

UNITED STATES PATENT AND TRADEMARK OFFICE

CERTIFICATE OF CORRECTION

PATENT NO. : 6,714,746 B2
DATED : March 30, 2004
INVENTOR(S) : Masanari Morioka et al.

It is certified that error appears in the above-identified patent and that said Letters Patent is hereby corrected as shown below:

Column 5,
Line 55, “distance,” should read -- distances, --.

Column 12,
Line 32, “receiving-” should read -- receiving --.

Column 27,
Line 54, “p times” should read -- p-times --.

Column 28,
Line 60, “V2bxp” should read -- V2bxp. --.

Column 31,
Line 47, “means;” should read -- means, --.

Column 33,
Line 35, “means;” should read -- means, --.

Signed and Sealed this

Twenty-seventh Day of July, 2004

JON W. DUDAS
*Acting Director of the United States Patent and Trademark Office*